US005956014A

United States Patent [19]

Kuriyama et al.

[11] Patent Number: 5,956,014

[45] **Date of Patent: *Sep. 21, 1999**

[54] BRIGHTNESS CONTROL AND POWER CONTROL OF DISPLAY DEVICE

[75] Inventors: Hirohito Kuriyama; Keiichi Kaneko; Rikurou Tanahashi; Akira Yamamoto; Shigeki Kameyama; Masaya Tajima; Shigetoshi Tomio; Tomokatsu Kishi, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/544,590

[22] Filed: Oct. 18, 1995

[30] Foreign Application Priority Data

Oct. 19, 1994 [JP] Japan ..... 6-253618
May 8, 1995 [JP] Japan ..... 7-109703

[51] Int. Cl.[6] ..... G09G 3/28

[52] U.S. Cl. ..... 345/147; 345/63

[58] Field of Search ..... 345/63, 77, 147, 345/211, 212, 89; 348/686, 687

[56] References Cited

U.S. PATENT DOCUMENTS 4,044,375 8/1977 Norman ..... 348/687
4,394,689 7/1983 Wallace et al. ..... 348/687
4,547,797 10/1985 Mick ..... 348/687
5,347,294 9/1994 Usui et al. ..... 345/89
5,583,527 12/1996 Fujisaki et al. ..... 345/211

FOREIGN PATENT DOCUMENTS 2-187788 7/1990 Japan .
4-11281 1/1992 Japan .
6-202580 7/1994 Japan .

OTHER PUBLICATIONS

Kawada et al., "Plasma Display Device," *Patent Abstracts of Japan* (Fujitsu Ltd) & JP 03282582 A, Dec. 12, 1991.
Toyama et al., "Color Plasma Display," *Patent Abstracts of Japan* (Oki Electric Ind Co Ltd) & JP 04051285 A, Feb. 19, 1992.

*Primary Examiner*—Jeffery Brier
*Attorney, Agent, or Firm*—Staas & Halsey

[57] ABSTRACT

In a plasma display panel, an analogue brightness value given by a variable resistor is periodically converted into a digital brightness value and stored in a memory. A digital brightness value of a current period is compared with the digital brightness value of the next preceding period stored in the memory, to produce a difference brightness value which is compared with a predetermined brightness value and, if larger than the predetermined value, the brightness value stored in the memory is updated. Alternatively, power consumption of a display device is detected and, when the power consumption is larger than a set point, a brightness value is gradually decreased and, when the power consumption is smaller than the set point, the brightness value is gradually adjusted to a brightness set value.

51 Claims, 18 Drawing Sheets

BRIGHTNESS CONTROL AND POWER CONTROL OF DISPLAY DEVICE

BACKGROUND OF THE INVENTION

1. Field of the Invention

The present invention relates to control of a display device and, more particularly, to brightness control and power control of a plasma display panel (PDP).

2. Description of the Related Art

Accompanying the widespread use of flat displays such as LCD, EL, PDP, etc. and to further improve display quality and brightness, in recent years there has been an increasing demand for a brightness controller which makes it possible to freely adjust the brightness of display in the use thereof so as to meet a variety of environmental conditions, covering a range from a lowest level of almost a dark state to a highest brightness level, while maintaining stability in the display.

A variety of brightness controllers have heretofore been provided for the display devices. In AC-type plasma display devices, the data to be displayed is written in write/erase-scan for every line and, then, the display is maintained by sustain discharges. The brightness of display varies in proportion to the number of the sustain discharges in one $V_{sync}$ time interval which defines a vertical scanning period of a screen, and, hence, can be changed by changing the number of the sustain discharges.

The brightness is controlled in a digital manner (stepwisely), as mentioned above. In practice, however, the brightness is adjusted by a user in an analog manner (continuously) by using a variable resistor. To stably control the brightness, therefore, the analog value must be stably converted into a digital value.

In a conventional brightness controller, periodical BC (brightness control) pulses whose duration is proportional to a set value of the variable resistor are generated in a BC pulse generator. The BC pulses are latched by a signal $\overline{H}_{sync}$ which defines a horizontal scanning period, in a latch circuit, to make a BC signal that is in synchronism with the signal $\overline{H}_{sync}$. During horizontal scanning periods in which the BC signal is at high level, drive signals that can cause the sustain discharges are applied to the PDP, and during horizontal scanning periods in which the BC signal is at low level, drive signals that cannot cause the sustain discharges are applied to the PDP.

In the above conventional brightness controller, the trailing edges of the BC pulses are occasionally very close to latch timing of a latch circuit, because the duration of the BC pulses can continuously vary according to the set value of the variable resistor. If the trailing edge of the BC pulse becomes very close to the latch timing of the latch circuit, the output of the latch circuit becomes unstable, making the brightness of the PDP unstable.

In general, when the whole screen is bright, this fluctuation such that the display is slightly brighter, or is slightly darker, than the mean brightness, and cannot be perceived by the human veiwer. When the same phenomenon takes place where the whole screen is dark, however, the fluctuation becomes much more larger than when the screen is bright and will be perceived by the human veiwer, the change appearing as flickering (flickering on the display screen).

Meanwhile, in the plasma display, the electric power is consumed in different amounts depending upon the rate at which display cells that are turned on (hereinafter referred to as a display rate), and the consumption of electric power increases with an increase in the display rate. Therefore, even when the brightness level is adjusted in the aforementioned manner, the consumption of electric power occasionally exceeds a permitted level. In order to prevent this situation, APC (automatic power control) is introduced to forcibly lower the brightness level so that the consumption of electric power is suppressed to be below the permitted level.

In a conventional APC function, the consumption of electric power is detected by detecting a mean current flowing through a high voltage power source for driving a PDP device. The detected current value is compared with a reference value, and periodical APC pulses, whose duration varies according to the comparison results, are generated in an APC pulse generator. The APC pulses are latched by the signal $\overline{H}_{sync}$ and ANDed with the BC signal to make the BC signal narrow. During horizontal scanning periods in which the narrow BC signal is at high level, drive signals that cause the sustain discharges are applied to the PDP, and during horizontal scanning periods in which the narrow BC signal is at low level, drive signals that cannot cause the sustain discharges are applied to the PDP.

Since the duration of the APC pulses also continuously varies in response to the detected current value, the same problem as with the BC pulses arises when the trailing edge of the APC pulse becomes very close to the latch timing of the latch circuit.

SUMMARY OF THE INVENTION

It is an object of the present invention to provide a brightness and power control method and apparatus for a plasma display, which do not make brightness of display unstable.

In accordance with the present invention, there is provided a display apparatus comprising:

a display panel including a plurality of display cells;

a storage unit for storing a brightness value;

an operation unit for calculating a difference between a brightness value input to the operation unit and said brightness value stored in said storage unit, and for updating said brightness value stored in said storage unit when the calculated difference is larger than a reference value; and a display driver for individually driving the display cells of said display panel in response to the brightness value stored in said storage unit.

In accordance with the present invention, there is also provided a display controller for controlling a display driver that drives a display panel, comprising:

a storage unit for storing a brightness value; and an operation unit for calculating a difference between a brightness value input to the operation unit and the brightness value stored in the storage unit, and for updating the brightness value stored in the storage unit when the calculated difference is larger than a reference value in order to use the updated brightness value in the display driver.

In accordance with the present invention there is also provided a method of controlling a display driver that drives a display panel, comprising the steps of:

storing a brightness value in a memory;

calculating a difference between an input brightness value and the brightness value stored in the memory; and updating the brightness value stored in the memory when the difference calculated in the calculating step is larger than a reference value, in order to use the updated brightness value in the display driver.

In accordance with the present invention, there is also provided a display apparatus comprising:

a display panel including a plurality of display cells;

a detector for detecting power consumption essentially in said display panel to obtain a power consumption value;

a controller for gradually decreasing a brightness value when the power consumption value is larger than a set point, and for gradually adjusting the brightness value to a brightness set value when the power consumption value is smaller than the set point; and a display driver for individually driving the display cells of said display panel in response to the brightness value so that brightness of the display cells varies according to the brightness value.

In accordance with the present invention, there is also provided display controller for controlling a display driver that drives a display panel, comprising:

a detector for detecting power consumption essentially in the display panel to obtain a power consumption value;

a controller for gradually decreasing a brightness value when the power consumption value is larger than a set point, and for gradually adjusting the brightness value to a brightness set value when the power consumption value is smaller than the set point, in order to use the brightness value in the display driver.

In accordance with the present invention, there is also provided a method of controlling a display driver that drives a display panel, comprising the steps of:

detecting power consumption essentially in said display panel to obtain a power consumption value;

gradually decreasing a brightness value when the power consumption value is larger than a set point;

gradually adjusting the brightness value to a brightness set value when the power consumption value is smaller than the set point; and outputting the brightness value in order to be used in the display driver.

DESCRIPTION OF THE PREFERRED EMBODIMENTS

The plasma display, plasma display controller and plasma display driving method according to the present invention and its various embodiments will now be described in detail with reference to the drawings.

The following description of the invention deals with a plasma display device of the two-electrode type using an X-electrode and a Y-electrode. It should, however, be noted that the present invention is in no way limited to such a two-electrode type plasma display device only but can also be adapted to a three-electrode type plasma display device employing an address electrode in addition to the X-electrode and Y-electrode. In this case, the results the same as those of the two-electrode type plasma display device can be obtained by using an X-driver unit, a Y-driver unit and an address driver unit instead of an X-driver unit and a Y-driver unit used in the two-electrode type plasma display device that is described below.

Figure 1:
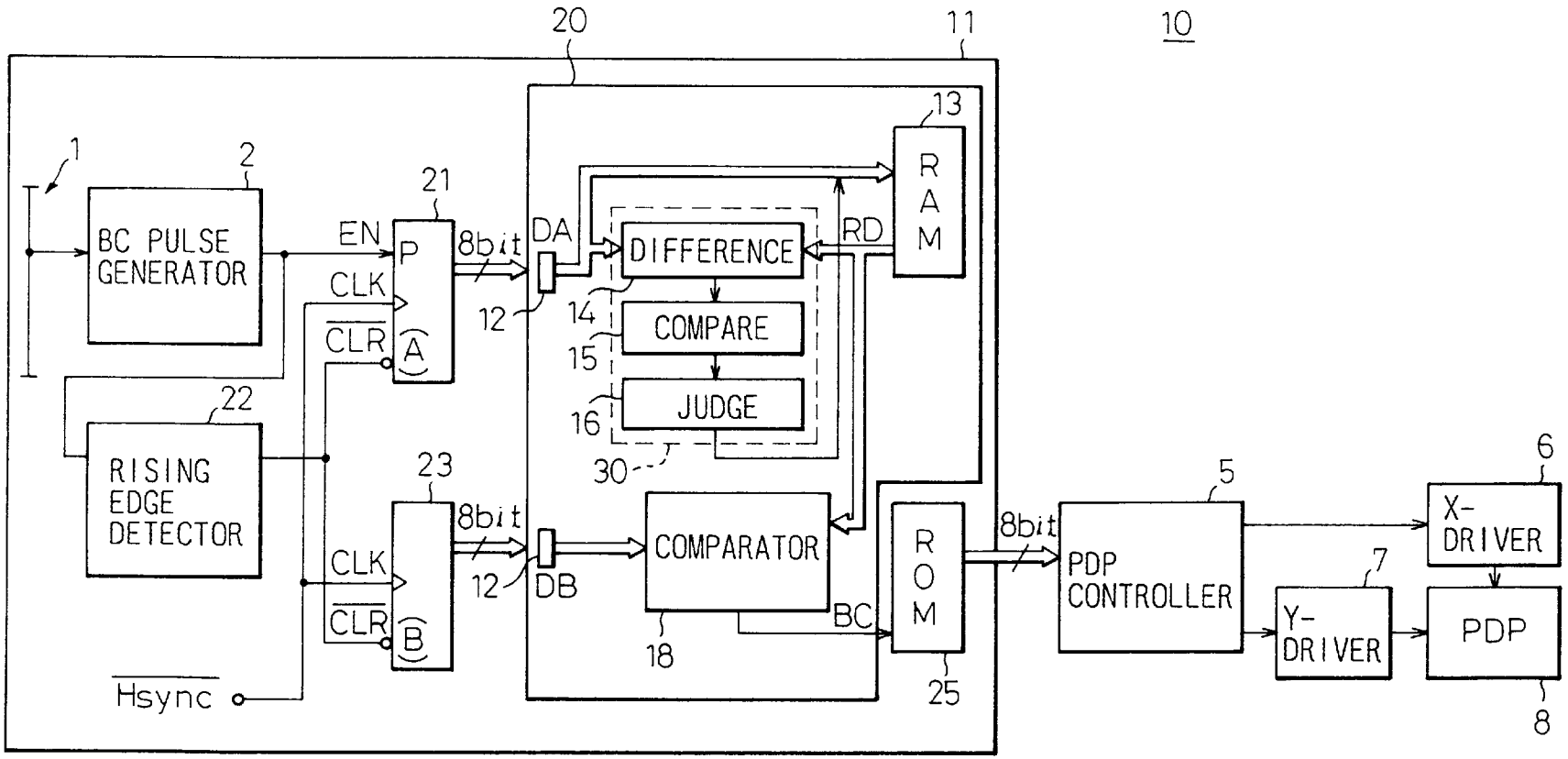
FIG. 1 is a block diagram of a plasma display according to an embodiment of the present invention.

FIG. 1 is a block diagram illustrating a fundamental constitution of a plasma display 10 according to a first embodiment of the present invention. The plasma display 10 shown in FIG. 1 includes a plasma display panel (PDP) unit 8 having display cells arranged on an X-Y orthogonal matrix, an X-driver unit 6 for selectively driving display cells of a single scanning line according to data to be displayed, a Y-driver unit 7 for selecting the single scanning lines in individual succession for the plural scanning line of the display, a plasma display controller unit 5 for controlling the X- and Y-drivers 6 and 7, and a brightness adjusting unit 11 which is connected to the plasma display controller unit 5 and generates control signals that selectively change the waveform of signals applied to X-driver unit 6 and Y-driver unit 7, between the high-brightness drive waveform and the low-brightness drive waveform, based upon a brightness set value. The brightness adjusting unit 11 includes a variable resistor 1 for manually setting the brightness set value, a BC pulse generator 2 for generating BC pulses whose duration is proportional to the brightness set value, a rising edge detector 22 for detecting rising edges of the BC pulses, a counter 21 for counting $\overline{H}_{sync}$ from the rising edge of the BC pulses to the trailing edge of the BC pulses and for outputting a count value DA, a counter 23 for counting $\overline{H}_{sync}$ from the rising edge of the BC pulses and for outputting a count value DB, a BC signal generating unit 20 for generating a stable BC signal, based on count values DA and DB of the counters 21 and 23, and a read only memory 25 for outputting the control signals to be fed to the PDP controller 5, based on the BC signal from the BC signal generating unit 20.

The BC signal generating unit 20 includes, as shown in FIG. 1, input units 12 for inputting data DA and DB from the counters 21 and 23, a storage unit ("RAM") 13 for storing DA as data RD, and an operation unit 30. The operation unit 30 includes a difference operation unit 14 which reads RD, comprising brightness data DA of one period before (i.e., the next preceding period) and that is stored in the storage unit 13 and which calculates a difference between DA of a current period and RD, a comparator unit 15 for comparing the difference output of unit 14 with a predetermined reference value, and a judging unit 16 which judges whether the variable resistor 1 is operated or not, i.e., whether the set value of the variable resistor 1 is changed or not in response to the output from said comparator unit 15.

In the present invention, the judging unit 16 has a function for judging whether the absolute value of the difference is smaller than, or larger than, the predetermined reference value which, though there is no particular limitation, can be set to be 2. That is, when the absolute value of the difference is not larger than the reference value, it is so judged that the difference is within a range of error and that the variable resistor 1 is not operated. In such a state, therefore, the data RD stored in the storage unit 13 is not updated. The storage unit 13 is implemented by, for example, RAM and the like.

When the absolute value of the difference is equal to, or larger than, the reference value, it is judged that the variable resistor 1 is operated. In such a state, therefore, the data RD stored in the storage unit 13 is updated using DA.

The data RD stored in the storage unit 13 and the data DB output from the counter 23 are compared in a comparator 18, which outputs a stable BC signal as a comparison result. That is, during a period where RD>DB the BC signal is at high level, and during a period where RD≦DB the BC signal is at low level.

Figure 2A:
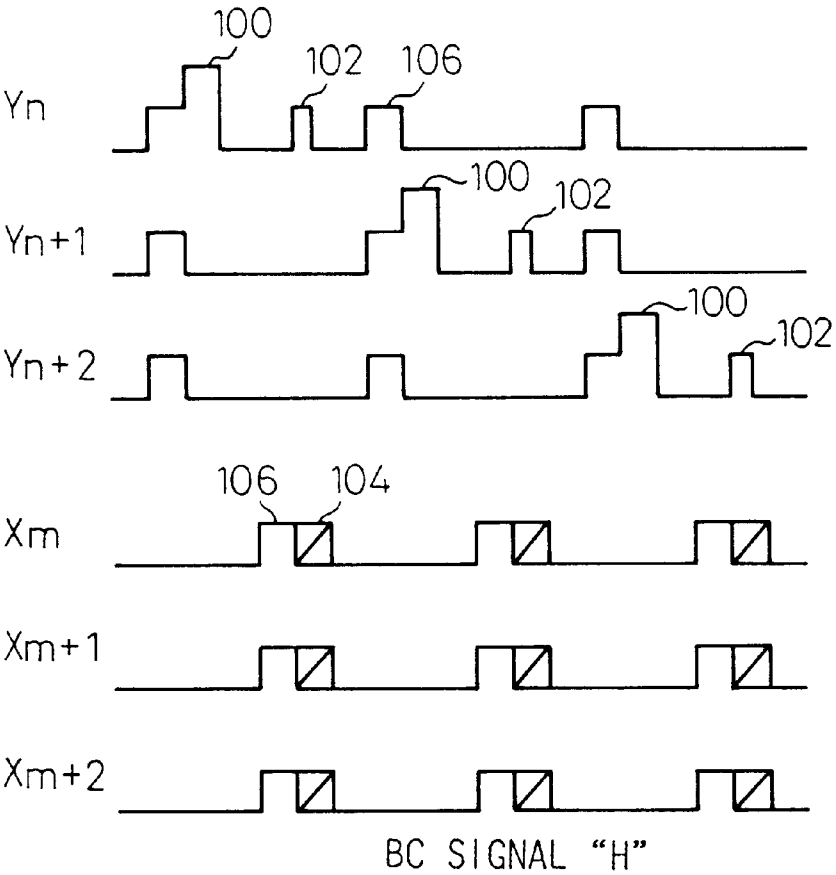
FIG. 2A is a waveform diagram showing high-brightness drive waveforms.

The BC signal is input to the most significant bit of an address input of the read only memory 25, and a count value of an address clock (not shown) is input to the other bits of the address input. The read only memory 25 outputs the control signals by outputting data addressed by the address input. During high level period of the BC signal, the read only memory 25 outputs control signals that cause the X-driver 6 and Y-driver 7 to output drive pulses as shown in FIG. 2A. During a low level period of the BC signal, the read only memory 25 outputs control signals that cause the X-driver 6 and Y-driver 7 to output drive pulses as shown in FIG. 2B.

Figure 2B:
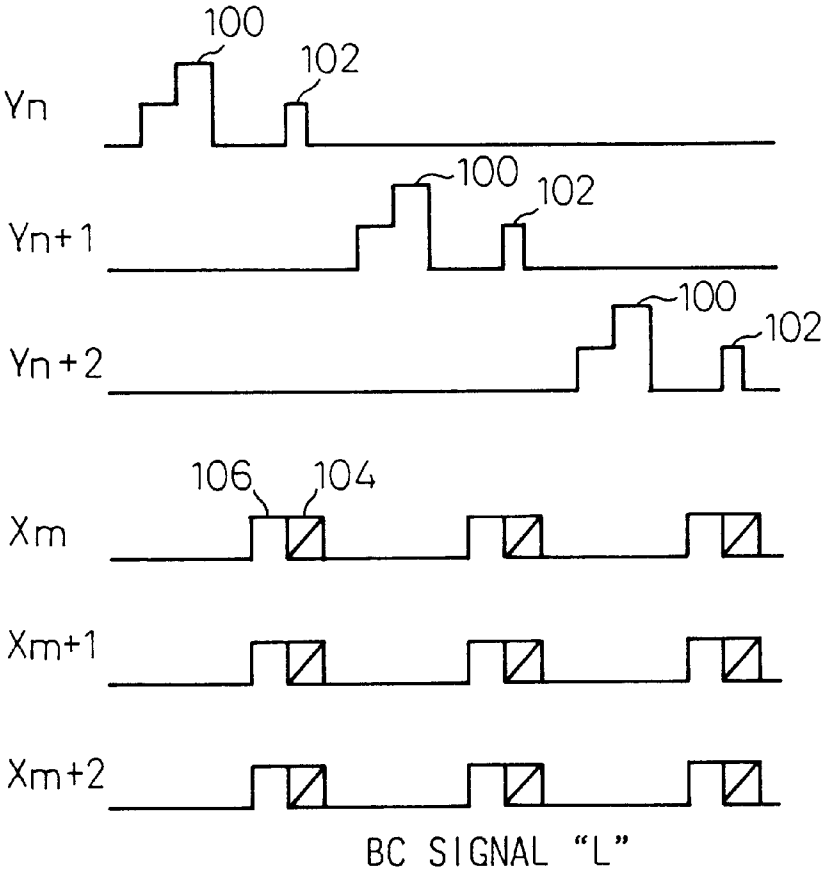
FIG. 2B is a waveform diagram showing low-brightness drive waveforms.

In FIGS. 2A and 2B, $X_m$, $X_{m+1}$ . . . represents output waveforms of X-driver 6 and $Y_n$, $Y_{n+1}$ . . . represents output waveforms of Y-driver 7. As shown in FIGS. 2A and 2B, write pulses 100 for selecting each scanning line one-by-one (i.e., in individual succession), erase pulses 102 following the write pulses 100, and data selection pulses 104 for selectively cancelling the erase pulses 102 according to data to be displayed equally appear in FIGS. 2A and 2B, but sustain pulses 106 alternately appear on X-side and Y-side in FIG. 2A, but appear on X-side only in FIG. 2B. The sustain pulses alternately applied between X-side and Y-side cause sustain discharges, but the sustain pulses applied on X-side only cannot cause the sustain discharges.

Figure 3:
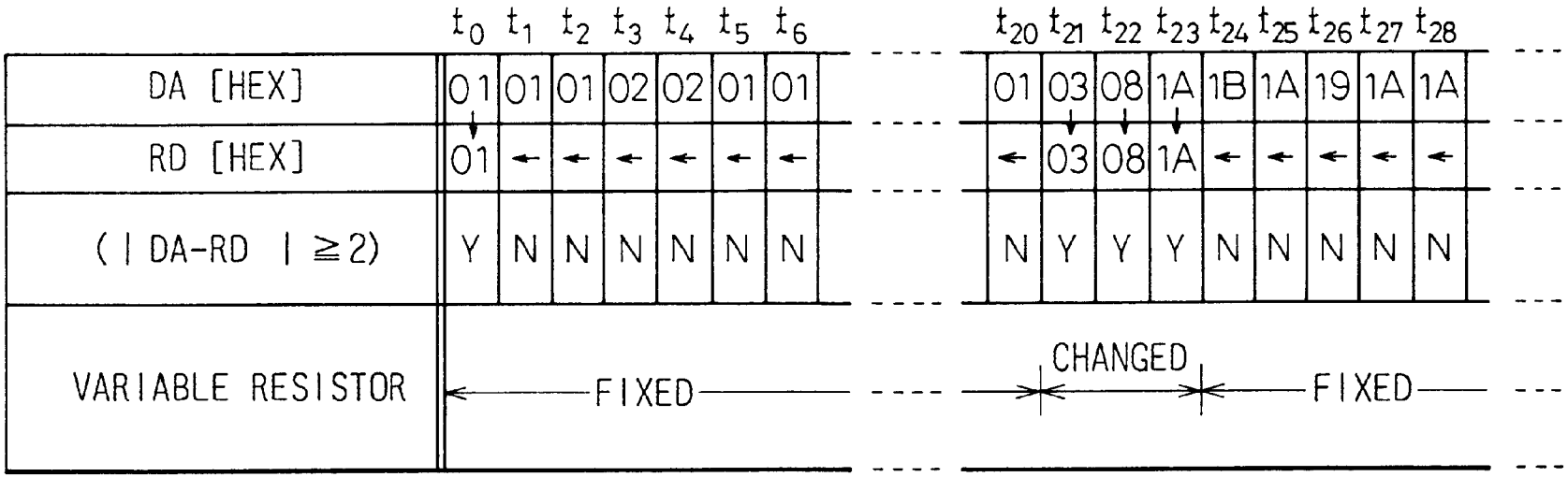
FIG. 3 is a diagram showing an example of operations of a BC signal generating unit according to a first embodiment of the present invention.

FIG. 3 shows an example of operations of the BC signal generating unit 20. The data DA slightly fluctuates from time $t_0$ to time $t_{20}$ and from time $t_{24}$ to time $t_{28}$, but since the difference between DA and RD is less than 2, it is decided that the variable resistor 1 is not operated, and the data RD is hence fixed to 01 or 1A. On the other hand, since the data DA suddenly varies from time $t_{21}$ to time $t_{23}$, it is decided that the variable resistor 1 is operated, and the data RD is hence changed according to the data DA.

Figure 4:
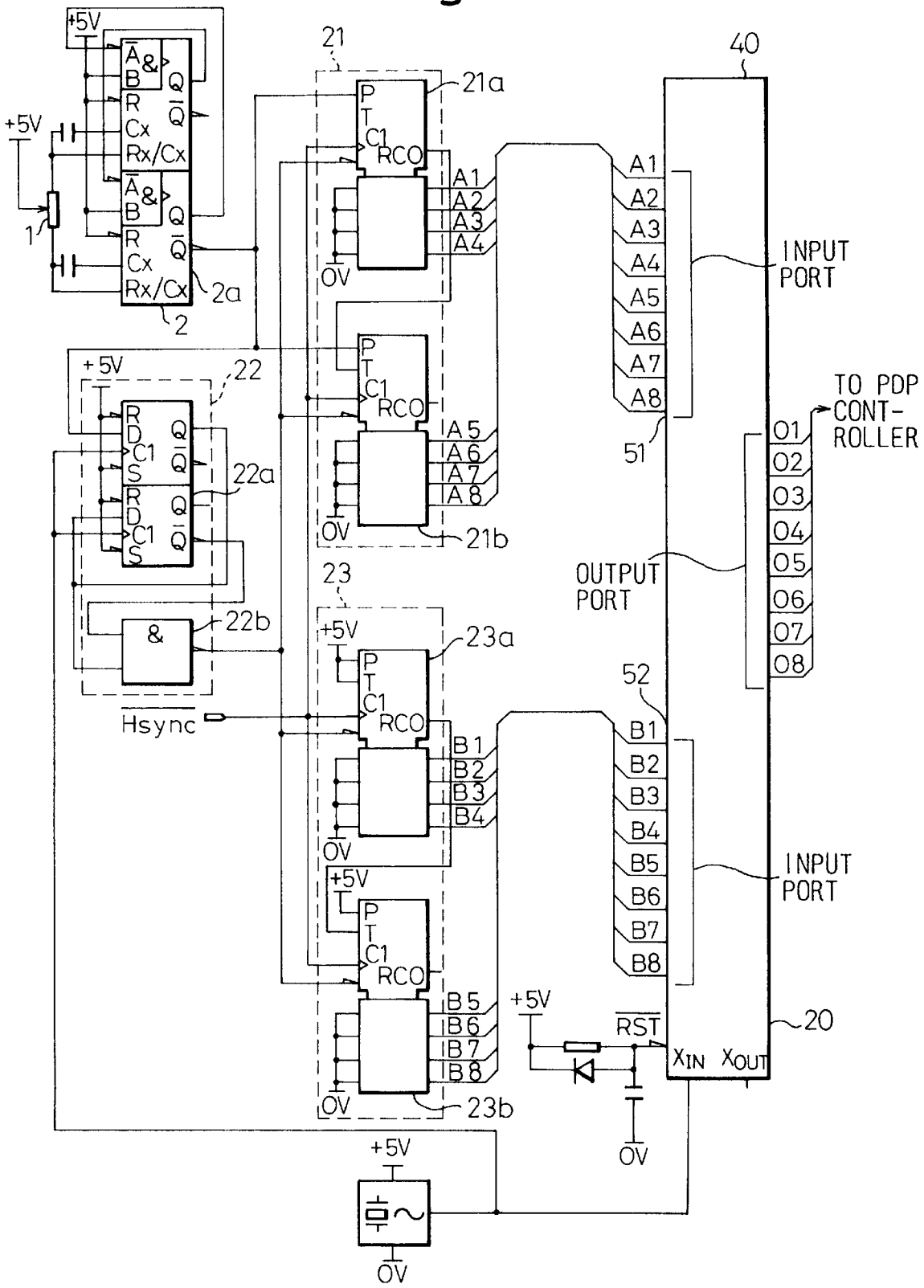
FIG. 4 is a circuit diagram showing a concrete constitution of the brightness-adjusting unit 11 of FIG. 1.

FIG. 4 is a circuit diagram illustrating a concrete constitution of the brightness-adjusting unit 11 of FIG. 1. The brightness control (BC) pulse generator 2 connected to the variable resistor 1 is implemented by a well-known one-shot multivibrator circuit 2*a*. The rising edge detector 22 is implemented by a flip-flop 22*a* and a NAND circuit 22*b*. The counter 21 is implemented by widely known counter IC's 21*a* and 21*b* which are connected in series, and the counter 23 is implemented by widely known counter IC's 23*a* and 23*b* which are connected in series.

The rising edge of the BC pulse is detected by the NAND circuit 22*b*, and a clear signal ($\overline{CLR}$) is formed for the counters 21 and 23.

The BC signal generating unit 20 and the read only memory 25 of FIG. 1 are implemented by a one-chip microcomputer 40 that contains a central processing unit (CPU), a random access memory (RAM), a read only memory (ROM) and an input/output port.

Figure 5:
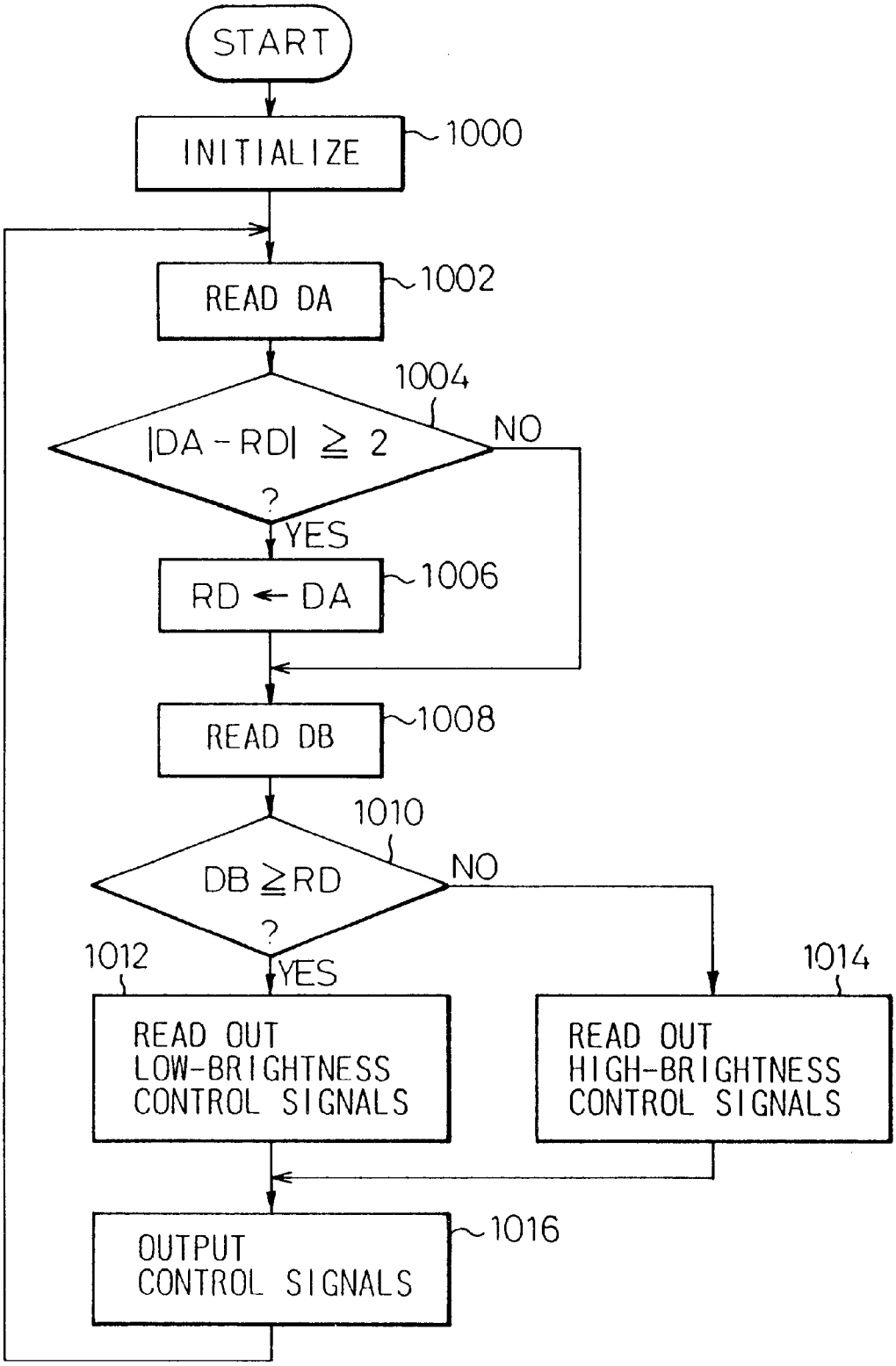
FIG. 5 is a flow chart showing an operation of the one-chip microcomputer 40 of FIG. 4.

FIG. 5 is a flow chart showing an operation of the one-chip microcomputer 40.

After the start in FIG. 5, initialization is executed at step 1000. At step 1002, operation is executed to read the data DA from the first counter 21. The procedure then proceeds to step 1004 where a difference is found from the stored data RD which is the brightness data of one period before (i.e., the period preceding the current period) as stored in the built-in RAM and where it is judged whether the absolute value of the difference is larger than or equal to a predetermined reference value, e.g., 2 or not. When the answer is yes, i.e., when the absolute value of the difference is larger than or equal to 2, the procedure proceeds to step 1006 where the data RD is updated by being replaced by the data DA that is newly input and the procedure proceeds to step 1008. When the answer is not at the step 1004, i.e., when the absolute value of the difference is smaller than 2, the procedure bypasses the step 1006, and the procedure proceeds to step 1008.

Next, at the step 1008, the counter output value DB of the second counter 23 is read out, and the procedure proceeds to step 1010 where the counter output value DB is compared with the data RD. If the value DB is greater than or equal to the data RD, low-brightness control signals stored in the built-in ROM are read out in step 1012, and if the value DB is less than the data RD, high-brightness control signals stored in the built-in ROM are read out in step 1014. The read-out control signals are output in step 1016, and the procedure returns to step 1002.

Figure 6:
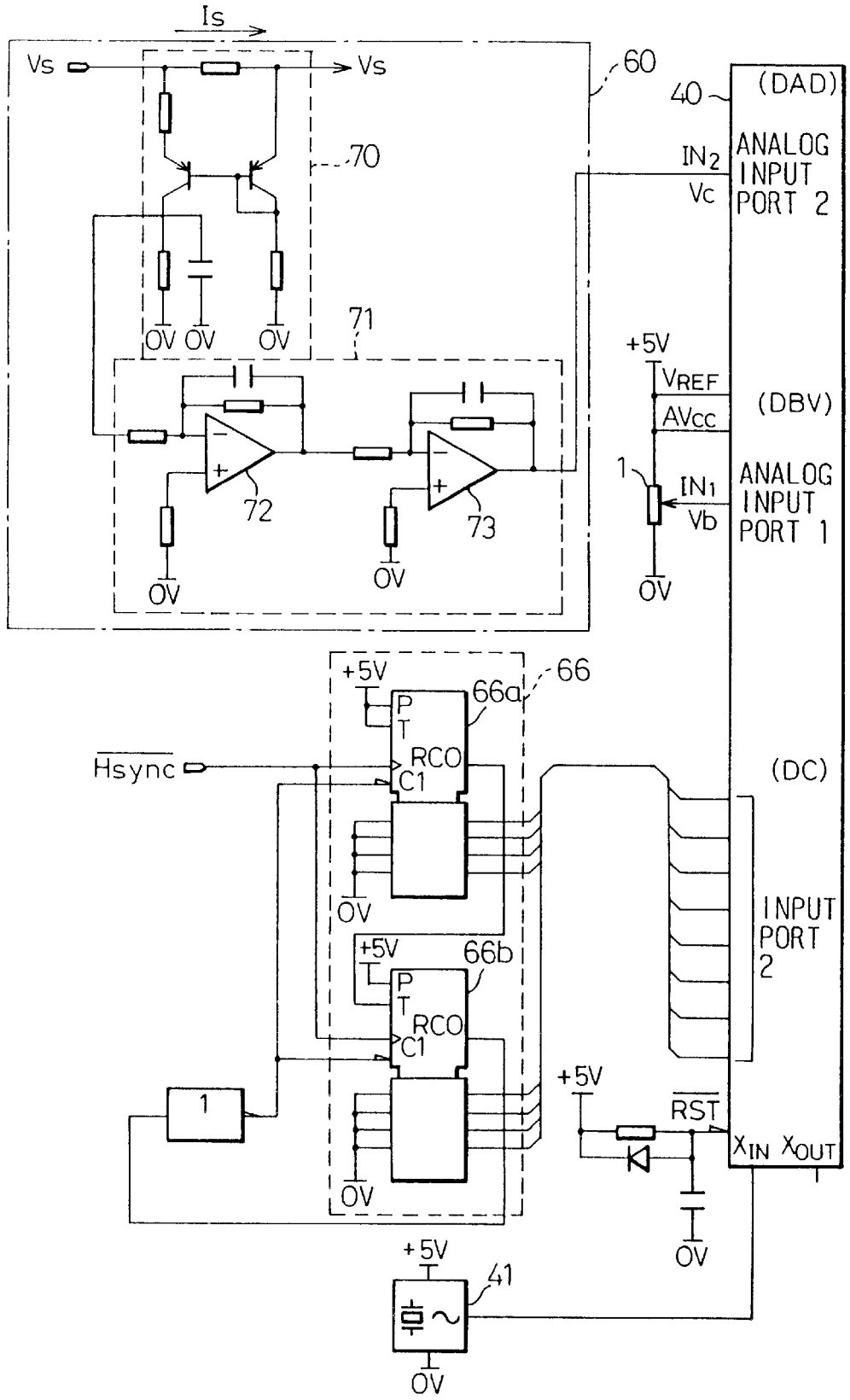
FIG. 6 is a circuit diagram of a brightness-adjusting unit according to a second embodiment of the present invention.

FIG. 6 is a circuit diagram illustrating a concrete constitution of a brightness-adjusting unit wherein the APC is introduced according to second embodiment of the present invention.

In FIG. 6, a current detecting unit 60 is provided for detecting a current Is flowing through a high voltage power source for the PDP. The detected current Is is used as an indication of the electric power consumption. The current detecting unit 60 includes a current mirror circuit 70 for detecting Is as a voltage value, and an integration amplifier 71 that is made up of two inverse amplifiers 72 and 73 connected in series to average the current detected by the current mirror circuit 70 and to match the voltage with an analog input voltage range of a microcomputer 40 that controls the brightness.

In this embodiment, the variable resistor 1 is directly connected to an analog input port (DBV) of the microcomputer 40.

A counter 66 which is connected to the microcomputer 40 is constituted in nearly the same manner as the counter 23 shown in FIG. 4 i.e., is constituted by the known counter IC's 66*a* and 66*b* connected in series, and its output is fed to the input port (DC) of the microcomputer 40.

The processing procedure of this embodiment will now be described with reference to the flow charts of FIGS. 7A to 7D.

Figure 7A:
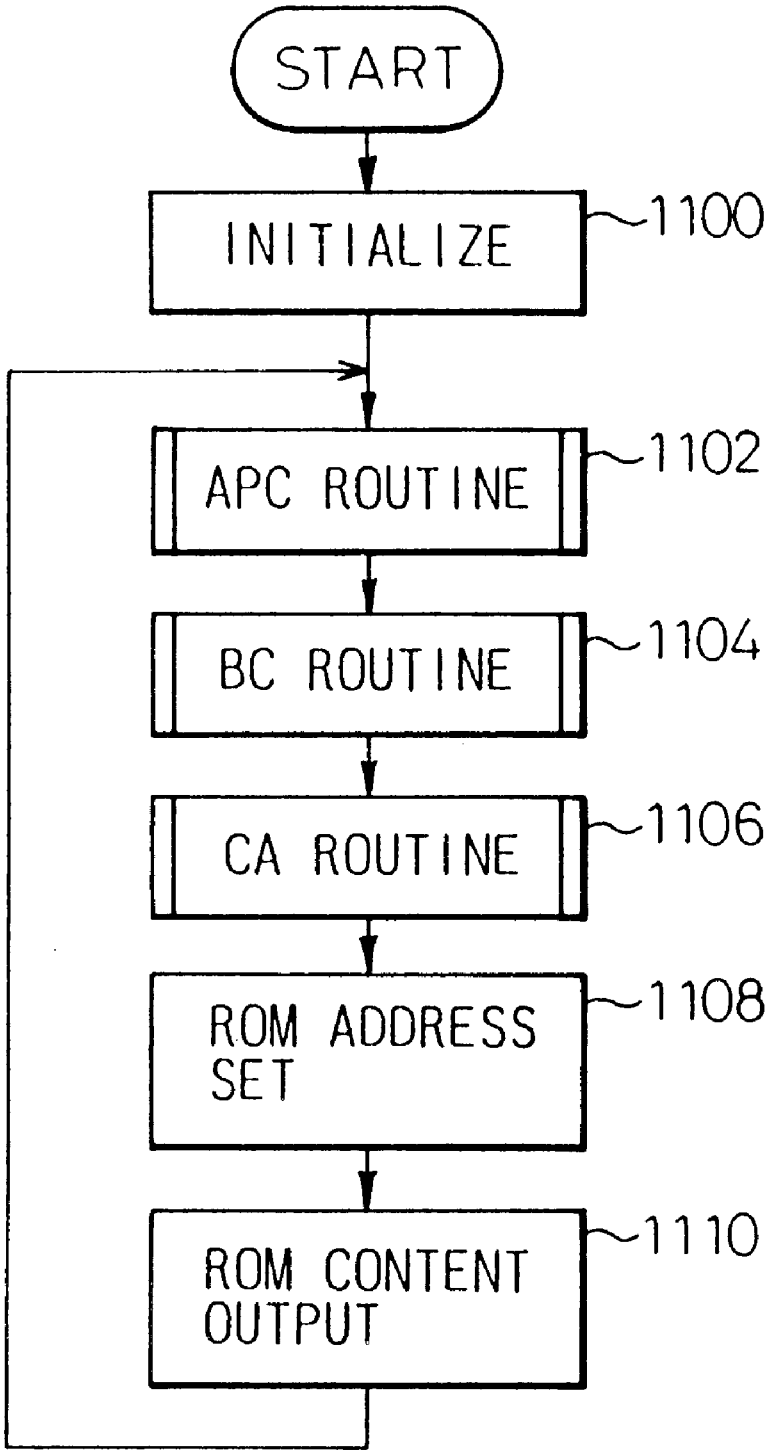
FIGS. 7A to 7D are flow charts showing an operation of the one-chip microcomputer 40 of FIG. 6.

After the start in the flow chart of FIG. 7A, initialization is executed in step 1100 and then the procedure proceeds to a step 1102 where an APC routine is called.

Figure 7B:
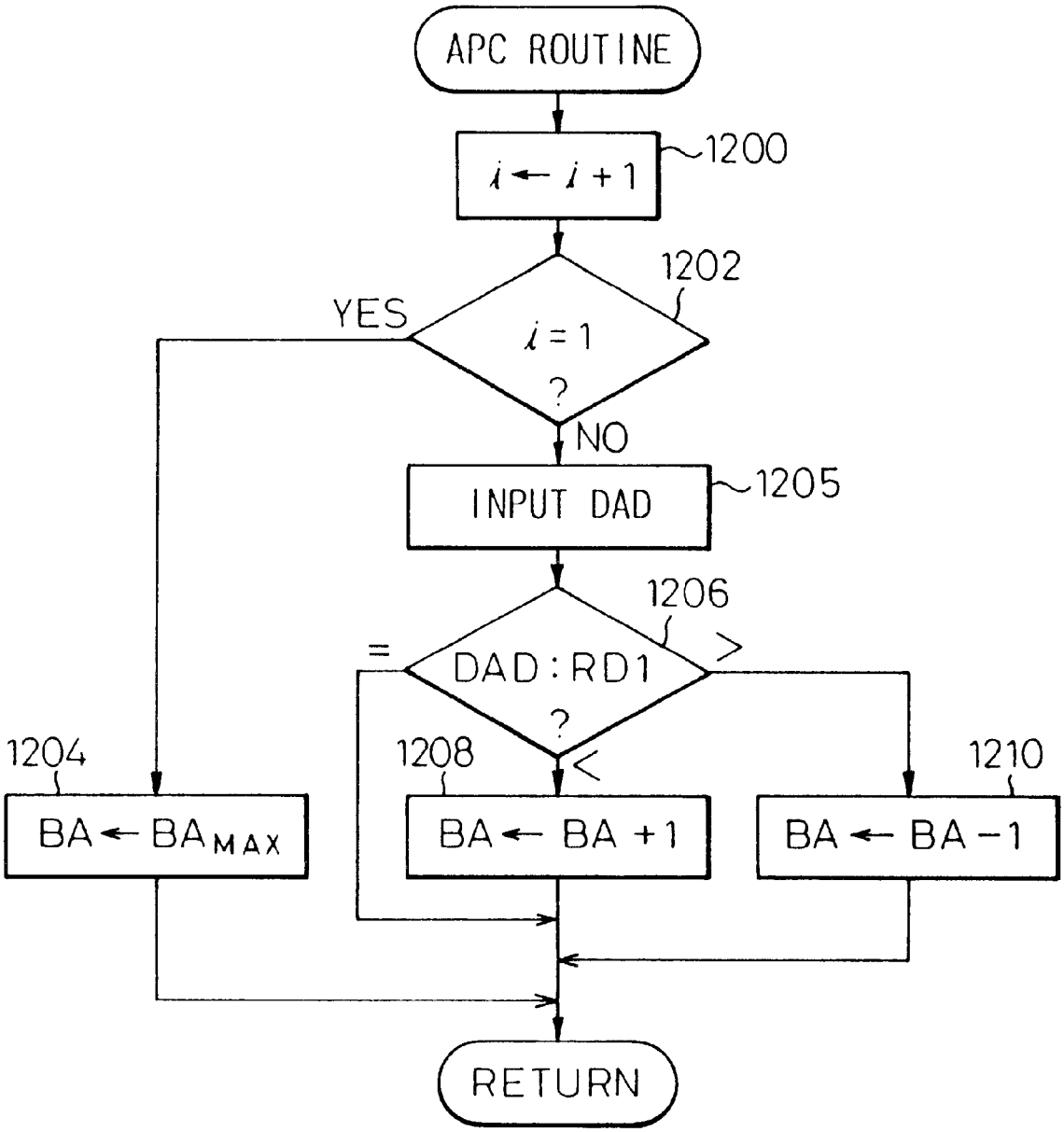

As for the APC routine as shown in FIG. 7B, an integer i that indicates the number of times of execution of the routine is updated at step 1200, and it is judged at step 1202 whether the integer i is 1 or not. When it is the first processing, the integer i is equal to 1, so that the answer is yes. The procedure then proceeds to step 1204 where an APC output BA is set to a maximum value, i.e., BA=255 is set.

When the APC routine is again called, i becomes 2 at step 1200 and the answer becomes no at step 1202. The procedure therefore proceeds to step 1205 where an analog signal that is output from the current-detecting unit 60 and that is input through an analog input port is subjected to an A/D conversion through an analog/digital convertor, to obtain a value DAD.

Then, at step 1206, the value DAD is compared with a predetermined reference value RD1 that has been determined for a current flowing into the display panel. When the value DAD of the detected current is equal to the reference value RD1, i.e., when DAD=RD1, the APC output BA is not changed.

When DAD<RD1 at the step 1206, i.e., when the value DAD of the detected current is smaller than the reference value RD1, the procedure proceeds to step 1208 where the calculation is carried out to step up the APC output BA by 1, i.e., BA+1.

When DAD>RD1 at the step 1206, i.e., when the value DAD of the detected current is larger than the reference value RD1, the procedure proceeds to step 1210 where the calculation is carried out to step down the APC output BA by 1, i.e., BA−1. When the value BA exceeds 255 in the above routine, BA is set to 255.

Figure 7C:
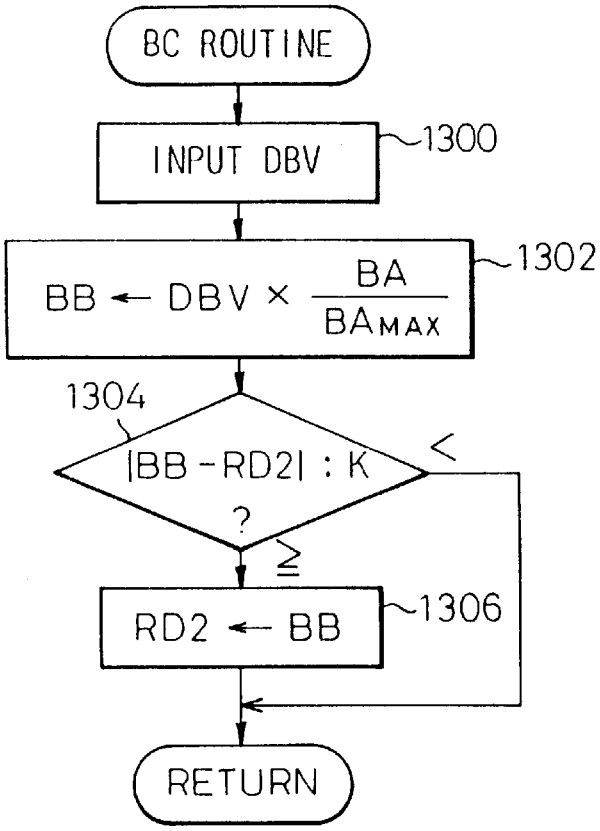

After the APC routine is finished, the procedure proceeds to step 1104 where a BC routine shown in FIG. 7C is called.

In FIG. 7C, an analog signal that is output from the variable resistor 1 and that is input through an analog input port is converted into a digital value by using a built-in analog/digital converter, to obtain a value DBV at step 1300.

The procedure then proceeds to step 1302 to find a ratio of the APC output BA obtained in the APC routine to $BA_{Max}$, i.e., to find BA/255 and, then, to effect the correction operation where the value DBV is multiplied by the ratio, i.e., BA/255, and to find the data BB.

The procedure then proceeds to step 1304 where the data BB of one period before is read out as data RD2. Then, a difference is found between the currently obtained data BB and the data RD2 to judge whether the absolute value of the difference is smaller than, or larger than, a predetermined reference value, e.g., K. In this embodiment, the reference value K can be set to be, for example, K=2.

When the absolute value of the difference between the data BB and the data RD2 is smaller than the reference value K, the data RD2 is not updated.

When the absolute value of the difference between the correction data BB and the data RD2 is greater than or equal to the reference value K at step 1304, on the other hand, the program proceeds to a step 1306 where the data RD2 is updated by being replaced by the data BB.

Figure 7D:
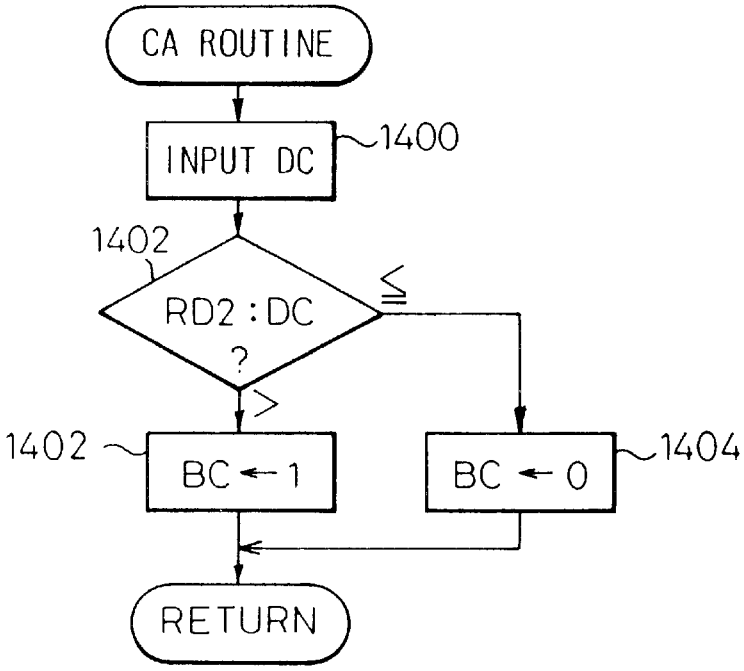

When the BC routine is finished, the procedure proceeds to step 1106 where a CA routine shown in FIG. 7D is called.

In the CA routine, when the procedure starts, the counted value DC of the signal $\overline{H}_{sync}$ counted by the counter 66 is input to the input port of the microcomputer 40. The counted value DC is read out at step 1400.

Then, the procedure proceeds to a step 1402 where the data RD2 is compared with the value DC. When the data RD2 is greater than the value DC, i.e., when RD2>DC, the procedure proceeds to step 1402 where the brightness control signal assumes the values "1". When the data RD2 is smaller than or equal to the value DC, i.e., when RD2≦DC, the procedure proceeds to step 1404 where the brightness control signal assumes the value "0".

Thereafter, the procedure returns back to the initial flow chart and at step 1108, access is made to the ROM depending upon the value of the brightness control signal output from the CA routine. The ROM outputs a predetermined display control signal pattern that is stored depending upon the address, and the display drive waveform having high-brightness waveform and low-brightness waveform at a ratio determined by the brightness control signal is fed to the plasma display controller unit 5.

Figure 8:
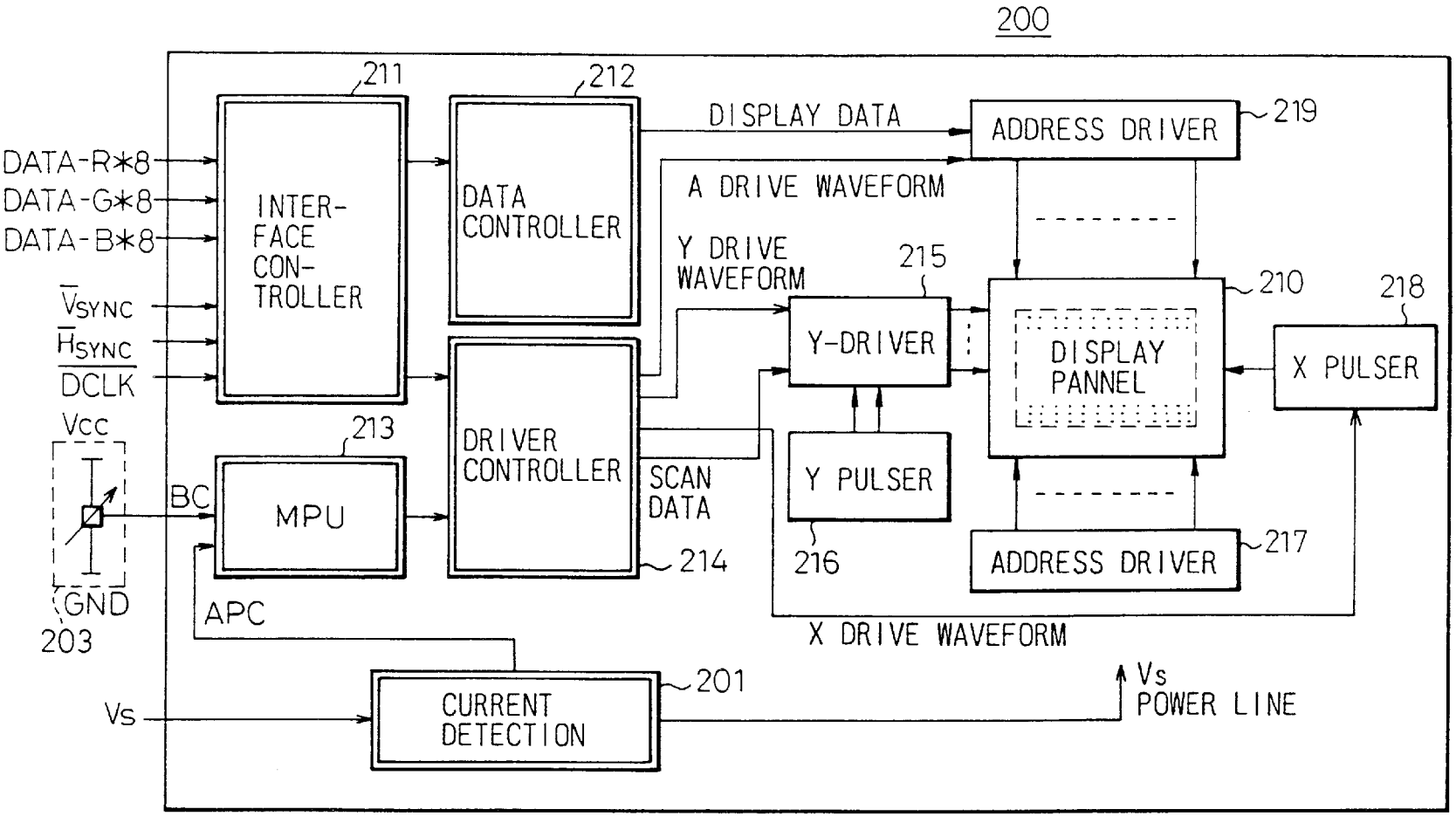
FIG. 8 is a block diagram of a display apparatus 200 according to a third embodiment of the present invention.

FIG. 8 shows a construction of a display apparatus according to third embodiment of the present invention. The display apparatus 200 includes a current detection unit 201; a variable resistor 203 for external brightness adjustment; an MPU 213 connected to outputs of the current detection unit 201 and the variable resistor 203; an interface controller 211 connected to signal lines of pixel data DATA-R, DATA-G and DATA-B, a vertical synchronizing signal $\overline{V}_{sync}$,a horizontal synchronizing signal $\overline{H}_{sync}$, and a clock signal $\overline{DCLK}$; a data controller 212 connected to an output of the interface controller 211; a driver controller 214 connected to outputs of the interface controller 211 and the MPU 213; a Y-driver 215 connected to an output of the driver controller 214 and connected to a Y pulser 216 for driving Y electrodes of a display panel 210; a X pulser 218 connected to the output of the driver controller 214, for driving X electrodes of the display panel 210; and address drivers 217 and 219 connected to an output of the data controller 212 and connected to the output of the driver controller 214, for providing the X electrodes of the display panel 210 with adequate image display data.

The display apparatus in the present invention is suitable as a display unit including a device that has a memory function and that is used as a screen of high-brightness, large surface and multiple color display. In particular, the display apparatus may be one that needs power consumption control according to the display rate because of large power consumption in a large-sized and high definition display.

Figure 9:
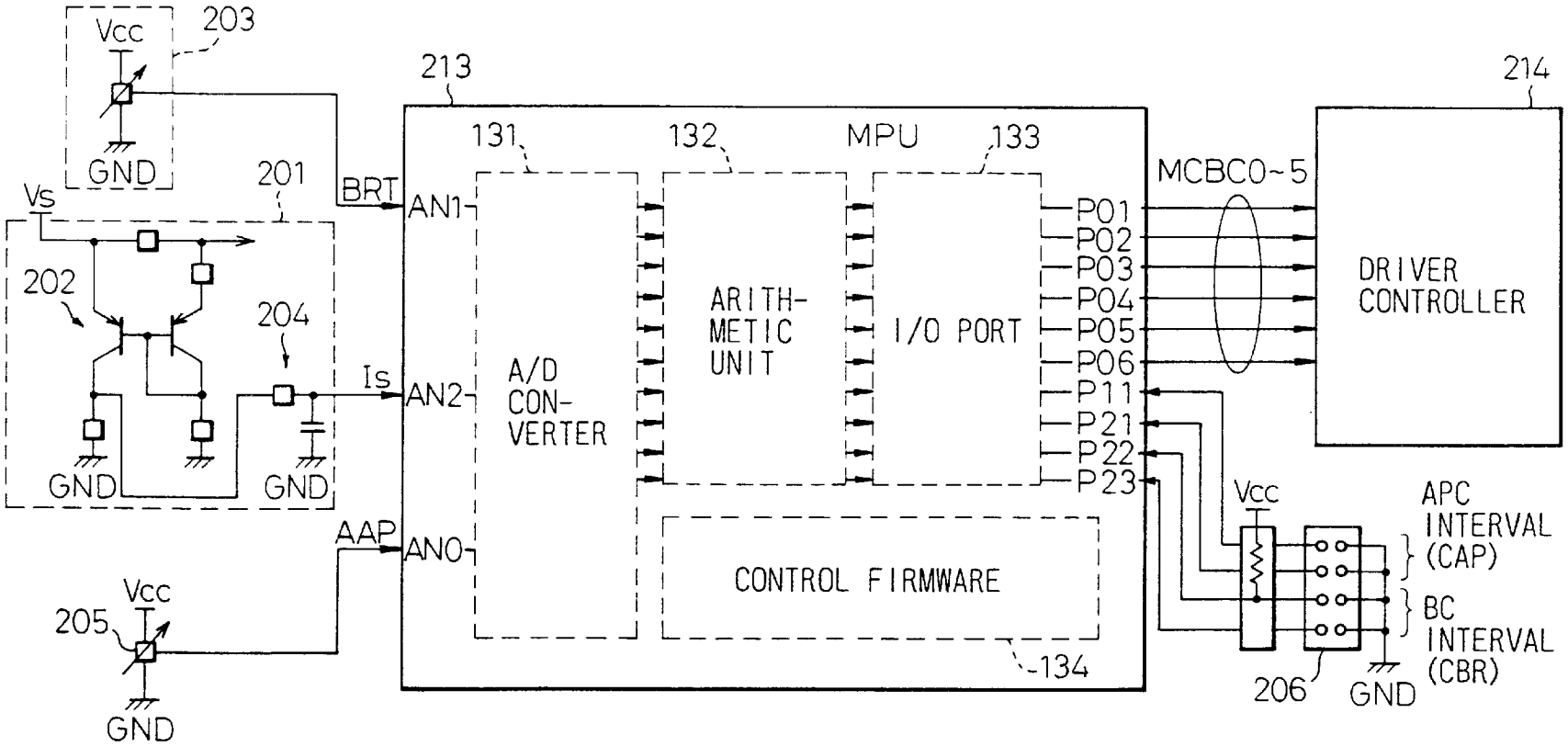
FIG. 9 is a circuit diagram showing a detailed construction of the MPU 213 in the display apparatus 200 of FIG. 8.

FIG. 9 shows detailed construction of the current detection unit 201 and the MPU 213. The same reference numerals as used in FIG. 8 are used for constituents which are the same as those in FIG. 8.

The current detection unit 201 includes a current mirror circuit 202 for detecting a current Is as a voltage signal, and an integration circuit 204 for averaging the voltage signal Is. The MPU 213 includes an A/D converter 131 having at least three analog input ports ANO, AN1 and AN2, an arithmetic unit 132, an input/output port 133 and a control firmware 134. An output of the variable resistor 203 that outputs a brightness set value BRT is connected to the port AN1. The current detection unit 201 outputs a power consumption value Is which is connected to the port AN2. A variable resistor 205 for adjusting a set point AAP of the power consumption value Is is connected to the port ANO. The MPU 213 outputs through the input/output port 133 a brightness value MCB consisting of six bit signals MCBC 0–5 to the driver controller 214. The driver controller 214 outputs drive waveforms that include effective sustain pulses, the number of which within a $V_{sync}$ period is proportional to the brightness value MCB. The MPU 213 can input, through the input/output port 133, an APC interval (CAP) consisting of two bit signals. The MPU 213 can also input a BC interval (CBR) consisting of two bit signals. CAP and CBR can be set by a switch 206.

FIGS. 10A to 10D are flow charts showing operations of the control firmware 134 of the MPU 213.

Figure 10A:
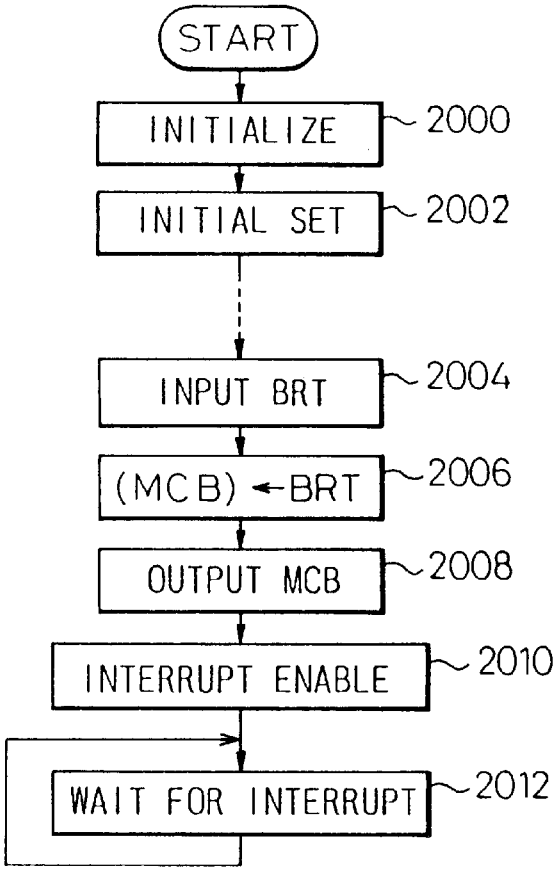
FIGS. 10A to 10D are flow charts showing an operation of the control firmware 134 of FIG. 9.

FIG. 10A is a main flow chart. In step 2000, initialization of every port of the MPU 213, setting of interruption mode and interruption vectors, and setting of a stack pointer are performed. In step 2002, initial setting, i.e., initial setting of values for every port and register is performed. In step 2004, an analog value input through the port AN1 is A/D-converted in the A/D converter 131 to obtain the brightness set value BRT, which is stored in a register (MCB) in step 2006, and which is output as the brightness value MCB in step 2008. In step 2010, the MPU 213 is enabled for interruptions and, in step 2012, waits for interruptions.

Figure 10B:
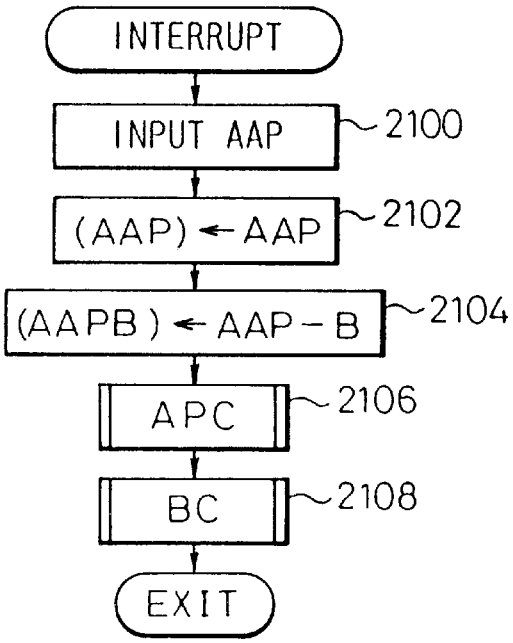

FIG. 10B shows an interruption routine which is executed when an interruption occurs. In step 2100, an analog value output from the variable resistor 205 is A/D-converted in the A/D converter 131 to obtain the set point AAP, which is stored in a register (AAP) in step 2102. In step 2104, a value AAP−B is calculated and stored in a register (AAPB). The value B is a predetermined constant value which can be set to be 6, for example. In step 2106 an APC routine is called, and in step 2108, a BC routine is called.

Figure 10C:
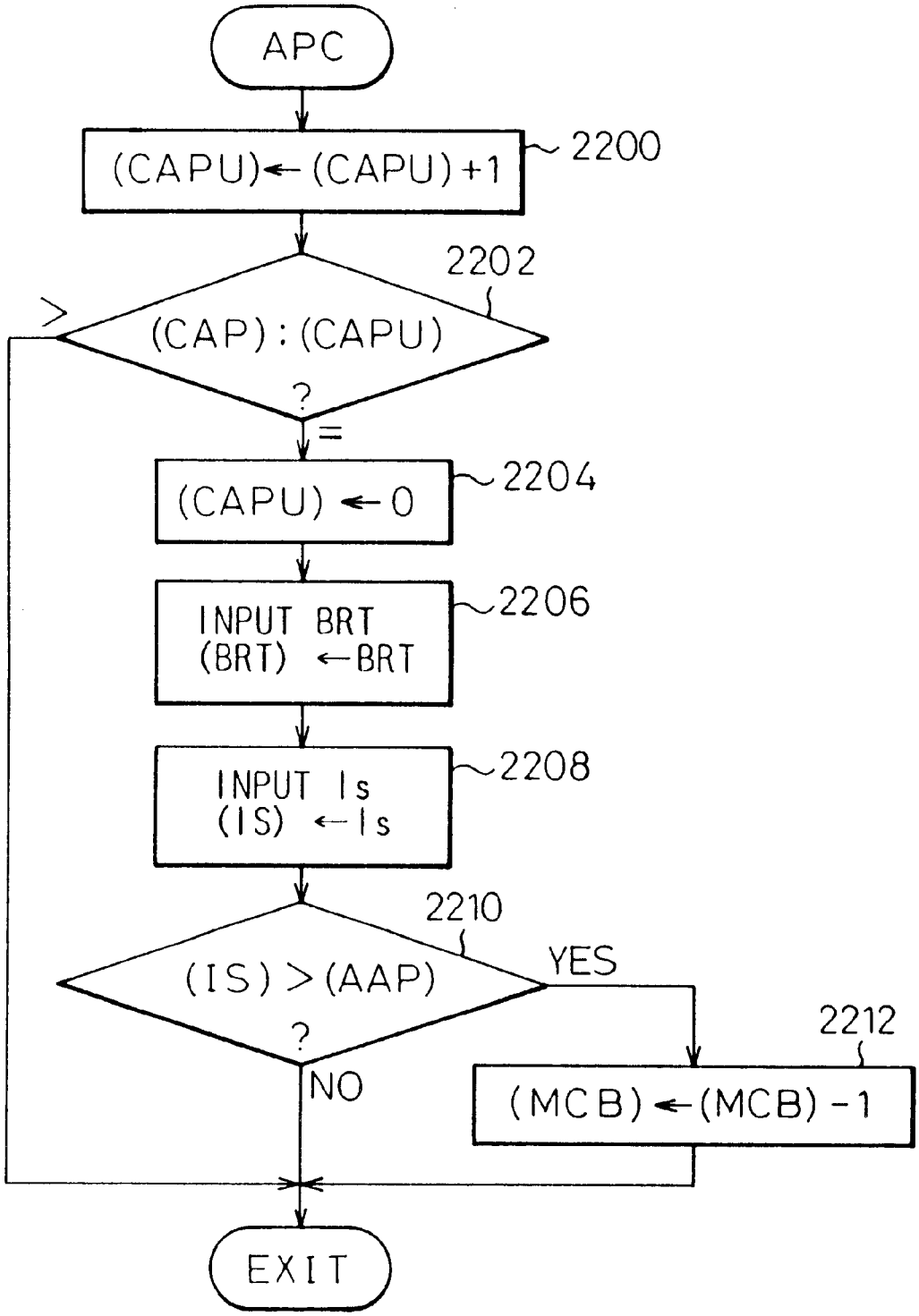

FIG. 10C shows the APC routine. In step 2200, an APC interval counter (CAPU) is incremented by 1 and, in step 2202, the content of (CAPU) is compared with the content of a register (CAP) which stores the APC interval CAP. If the value stored in (CAPU) reaches the value stored in (CAP), then (CAPU) is cleared in step 2204, and an APC processing is executed. In step 2206, the brightness set value BRT is input through the port AN1 and the A/D converter 131, and the value BRT is stored in a register (BRT). In step 2208, the power consumption value Is is input through the port AN2 and the A/D converter 131, and the value Is is stored in a register (IS). In step 2210, the value Is stored in (IS) is compared with the set point AAP stored in (AAP). If (IS) is larger than (AAP), the value stored in (MCB) is decremented by 1 in step 2212.

Figure 10D:
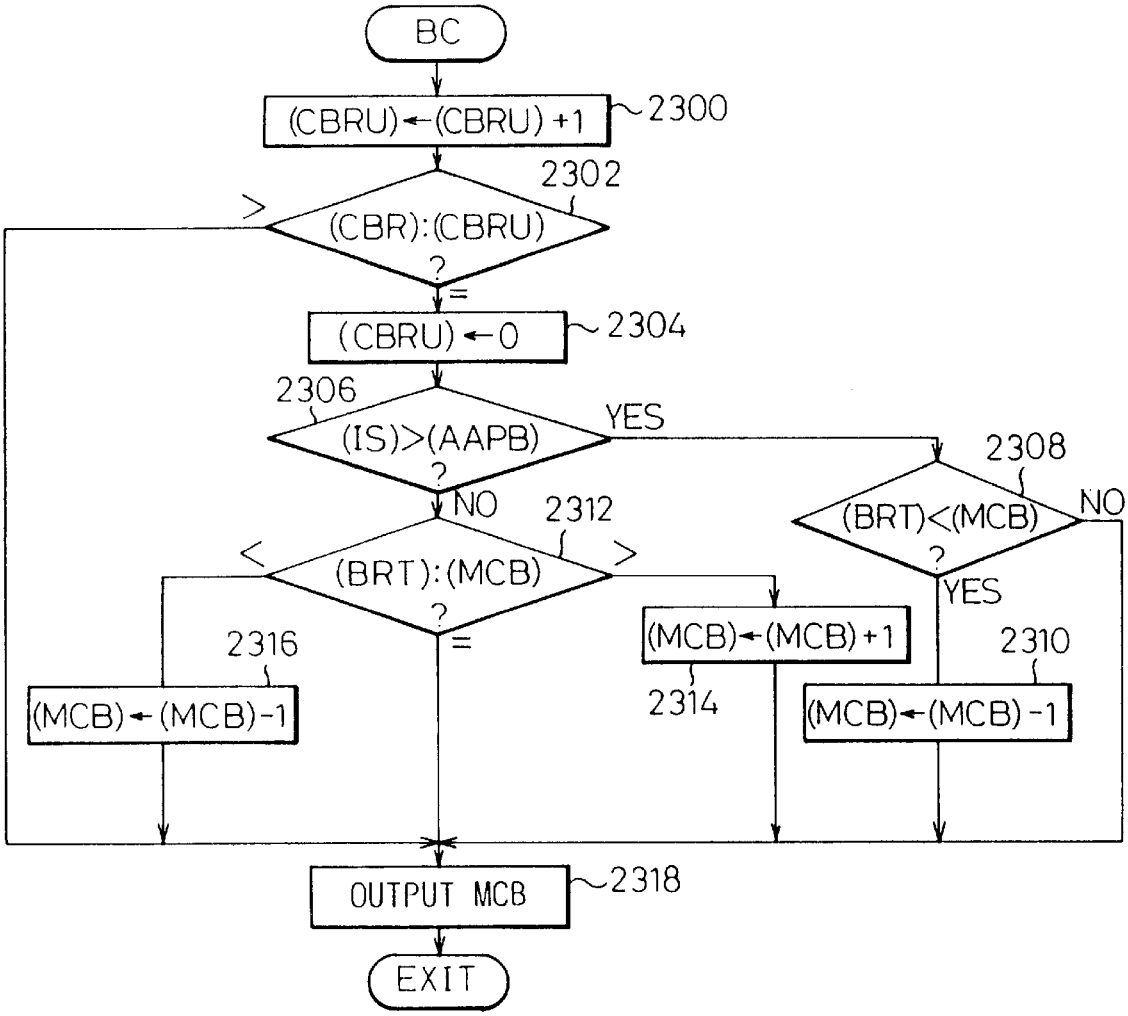

FIG. 10D shows the BC routine. In step 2300, a BC interval counter (CBRU) is incremented by 1. In step 2302, the content of (CBRU) is compared with the content of a register (CBR) which stores the BC interval CBR. If the value stored in (CBRU) reaches the value stored in (CBR), the procedure is advance to step 2304, where (CBRU) is cleared. Next, in step 2306, the content of (IS) is compared with the content of (AAPB). If the value Is is larger than AAP−B, the procedure is advanced to step 2308 where the brightness set value BRT is compared with the brightness value MCB. If the MCB is larger than BRT, MCB is decremented by 1 in step 2310. If the value Is is smaller than AAPB in step 2306, BRT is compared with MCB in step 2312. If BRT is larger than MCB, MCB is incremented by 1 in step 2314. If BRT is smaller than MCB, MCB is decremented by 1 in step 2316. In all of the above cases, the procedure is advanced to step 2318 where the MCB thus determined is output to the driver controller 214.

Figure 11:
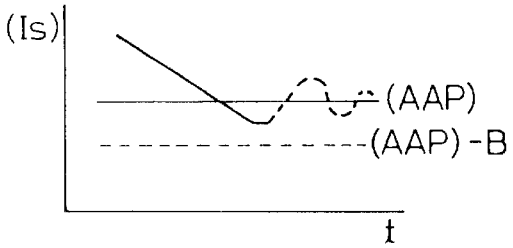
FIG. 11 is a graph explaining an APC control in the third embodiment.
Figure 12:
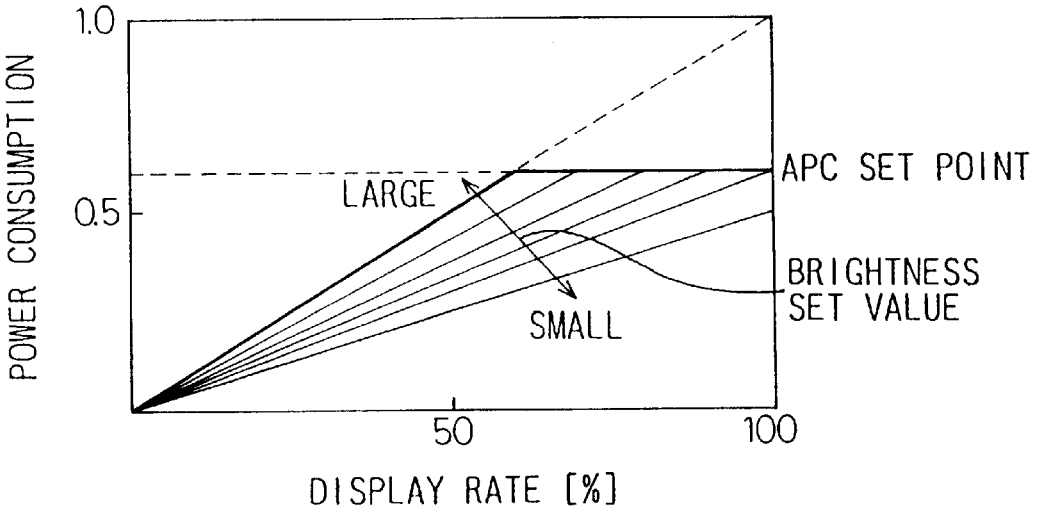
FIG. 12 is a graph showing power consumption versus display rate characteristics of the third embodiment.
Figure 13:
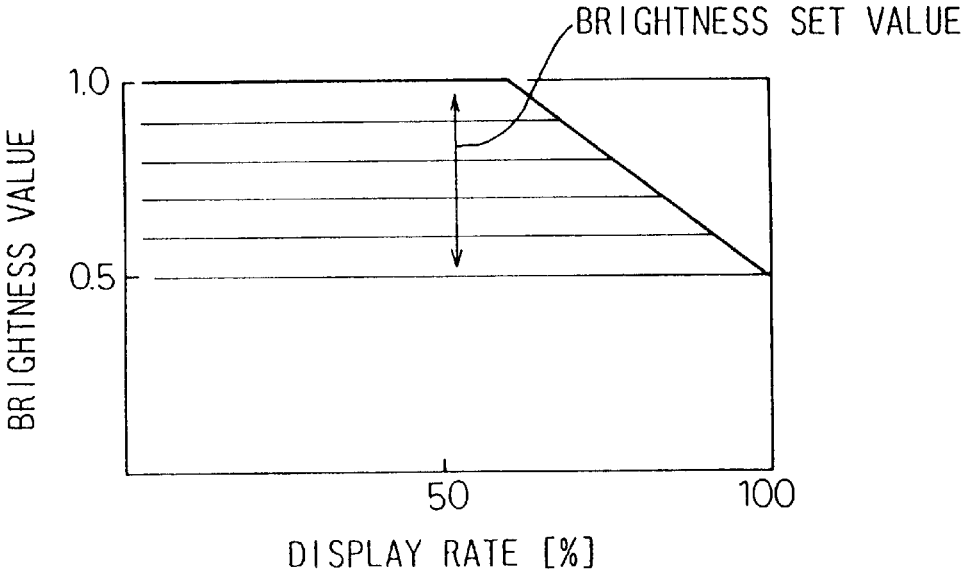
FIG. 13 is a graph showing brightness value versus display rate characteristics of the third embodiment.

As explained above, when Is, which is an estimate of power consumption of PDP, is larger than the set point AAP, the brightness value MCB is gradually decreased. When Is is smaller than AAP−B, MCB is controlled so that it gradually approaches the brightness set value BRT. When Is is within a range between AAP and AAP−B, MCB is not changed as long as BRT is larger than MCB. Therefore, if BRT is large enough, MCB is controlled so that Is gradually approaches AAP as shown in FIG. 11. If BRT is small so that Is does not exceed AAP−B, MCB is controlled so that it gradually approaches BRT. FIG. 12 and FIG. 13 show power consumption versus display rate characteristics and brightness value versus display rate characteristics, respectively, for various different brightness set values, which are obtained in the embodiment explained with reference to FIGS. 10A to 10D. As shown in FIG. 12, the power consumption is proportionally increased as the display rate is increased, and its gradient is determined by the brightness set value. Nevertheless, the power consumption does not exceed the APC set point, since the brightness value MCB is suppressed as shown in FIG. 13.

The processing period of the APC routine of FIG. 10C is determined by the APC interval CAP, and the processing period of the BC routine of FIG. 10D is determined by the BC interval CBR. CAP and CBR may be given as constants in advance. Alternatively, CAP and CBR can be externally set by the switch 206 of FIG. 9. When Is becomes larger than AAP because of a sudden increase in the display rate, MCB is gradually decreased at a speed determined by CAP. On the other hand, when Is becomes smaller than AAP because of sudden decrease in the display rate and when BRT is larger than MCB, MCB is gradually increased at a speed determined by CBR. In the former case, a sudden decrease in brightness is felt unnatural because there are many display cells that are tuned on but, in the latter case, a sudden increase in brightness is not felt unnatural because display cells that are turned on are few. Therefore, it is preferable that the APC interval CAP is greater than the BC interval CBR.

Figures 14A, 14B, 14C:
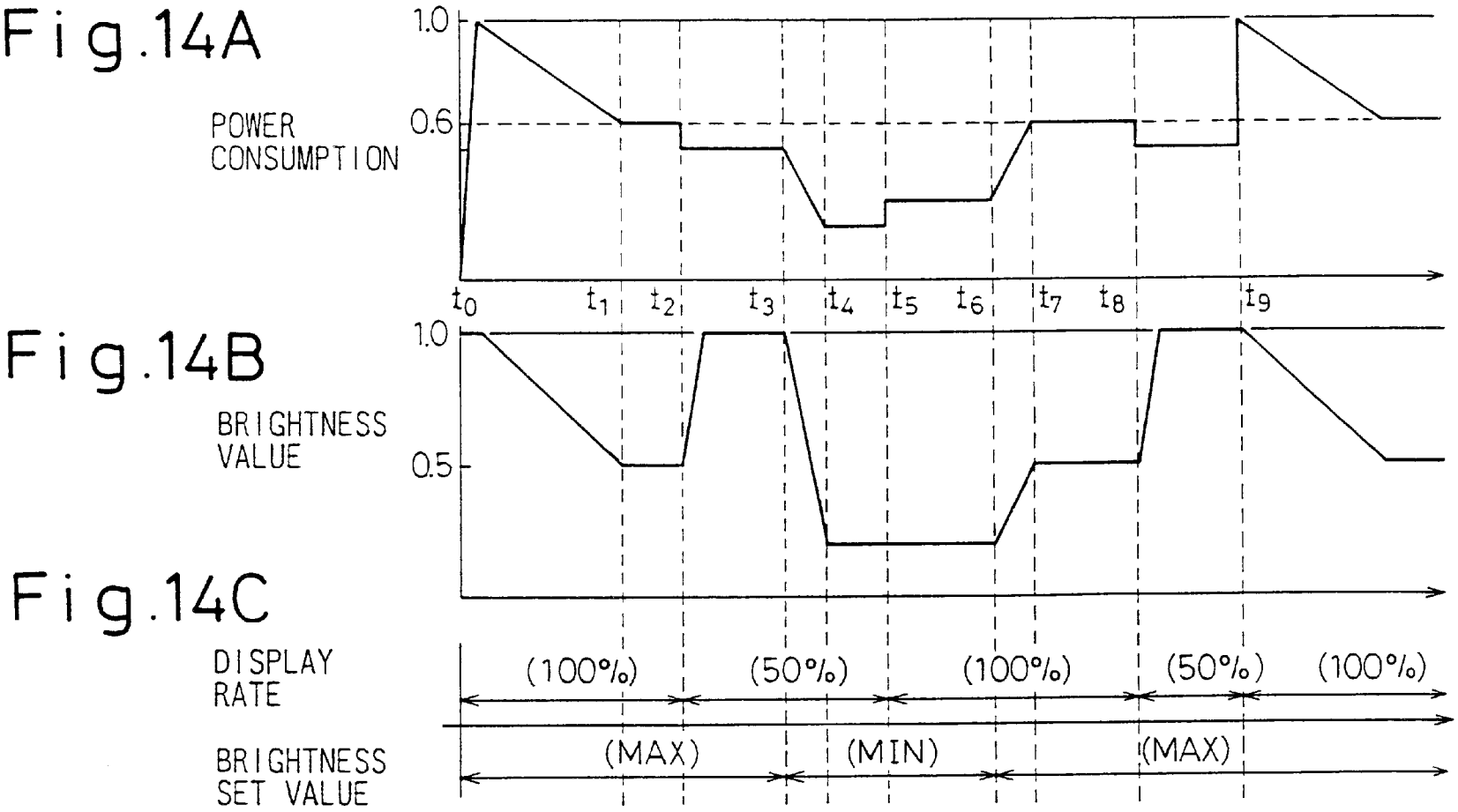
FIG. 14 is a diagram showing an example of the operations of the third embodiment.

FIG. 14 shows an example of operations of the third embodiment. In this example, the APC set point is set at 0.6 of the maximum power consumption. As shown in FIG. 14, the display rate is 100% and the brightness set value is a maximum at time $t_0$. First, the power consumption rises up to its maximum since the brightness value is set at its maximum by steps 2006 and 2008 of FIG. 10A. Then, the power consumption is gradually decreased by gradually decreasing the brightness value in step 2212 of FIG. 10C and is settled at the APC set point 0.6 from $t_1$ to $t_2$. Next, since the display rate decreases to 50% at $t_2$, the power consumption decreases and therefore the brightness value is gradually increased up to its maximum level by step 2314 of FIG. 10D. At time $t_3$ the brightness set value is changed to its minimum level. Then, the brightness value is gradually decreased until the brightness value becomes equal to the brightness set value by step 2316 of FIG. 10D. At time $t_5$, the display rate increases to 100%, but since the power consumption does not exceed the APC set point, the brightness value is not changed. At time $t_6$, since the brightness set value is changed to its maximum level, the brightness value is gradually increased until the power consumption reaches the APC set point at time $t_7$. When the display rate decreases to 50% at time $t_8$, the brightness value is changed to its maximum level since the power consumption decreases below the APC set point and the brightness set value is at the maximum level. After that, when the display rate changes to 100%, the brightness value is gradually decreased to decrease the power consumption to the set point.

In the above embodiment, the APC set point is fixed to the set value of the variable register 205. Therefore, the brightness of the PDP cannot be manually changed while the brightness value is suppressed by the APC routine (APC-first mode). When it is desired that the brightness is always manually adjustable, this is realized by varying the APC set point by multiplying it by the brightness set value (BC-first mode). It is preferable that an operation mode is externally selectable between the above two operation modes according to the use of the display device.

The consumed power is detected by detecting the current assuming that power voltages are equal with regard to individual PDPs, in the above embodiment. Alternatively, the consumed power or the APC set point can be corrected by detecting the power voltage VS using a suitable voltage divider 205 and the A/D converter 131.

Figure 15:
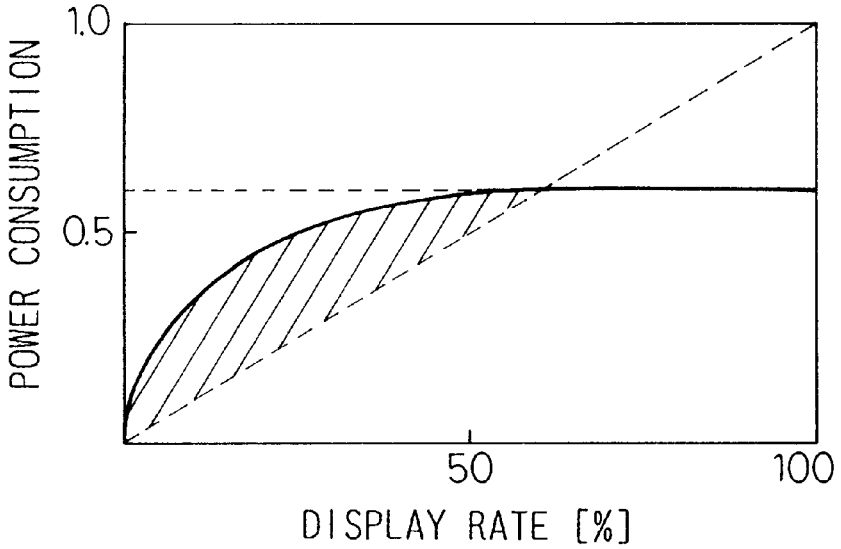
FIG. 15 is a graph showing power consumption versus display rate characteristics of another embodiment.
Figure 16:
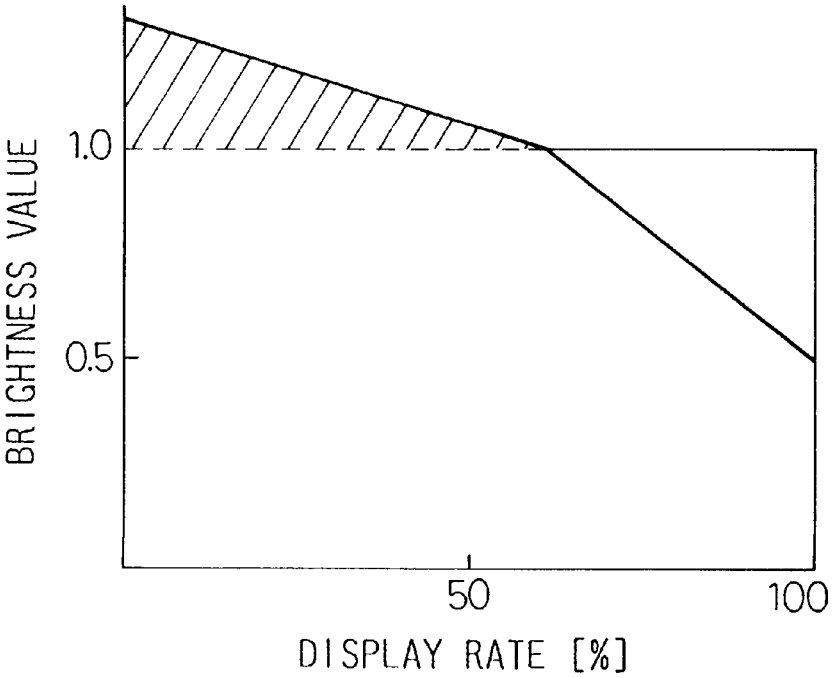
FIG. 16 is a graph showing brightness value versus display rate characteristics of the embodiment.

In the above embodiment, since the brightness value is controlled based on only the brightness set value when the power consumption is below the set point, the power consumption, that is to say, the brightness of the whole PDP display, is linearly decreased as the display rate decreases, as shown in FIG. 12. Brightness of the whole PDP can be maintained to a certain extent, as shown in FIG. 15, by controlling the brightness value as a function of the display rate, and which can be estimated from the brightness value and the power consumption, as shown in FIG. 16.

Figure 17:
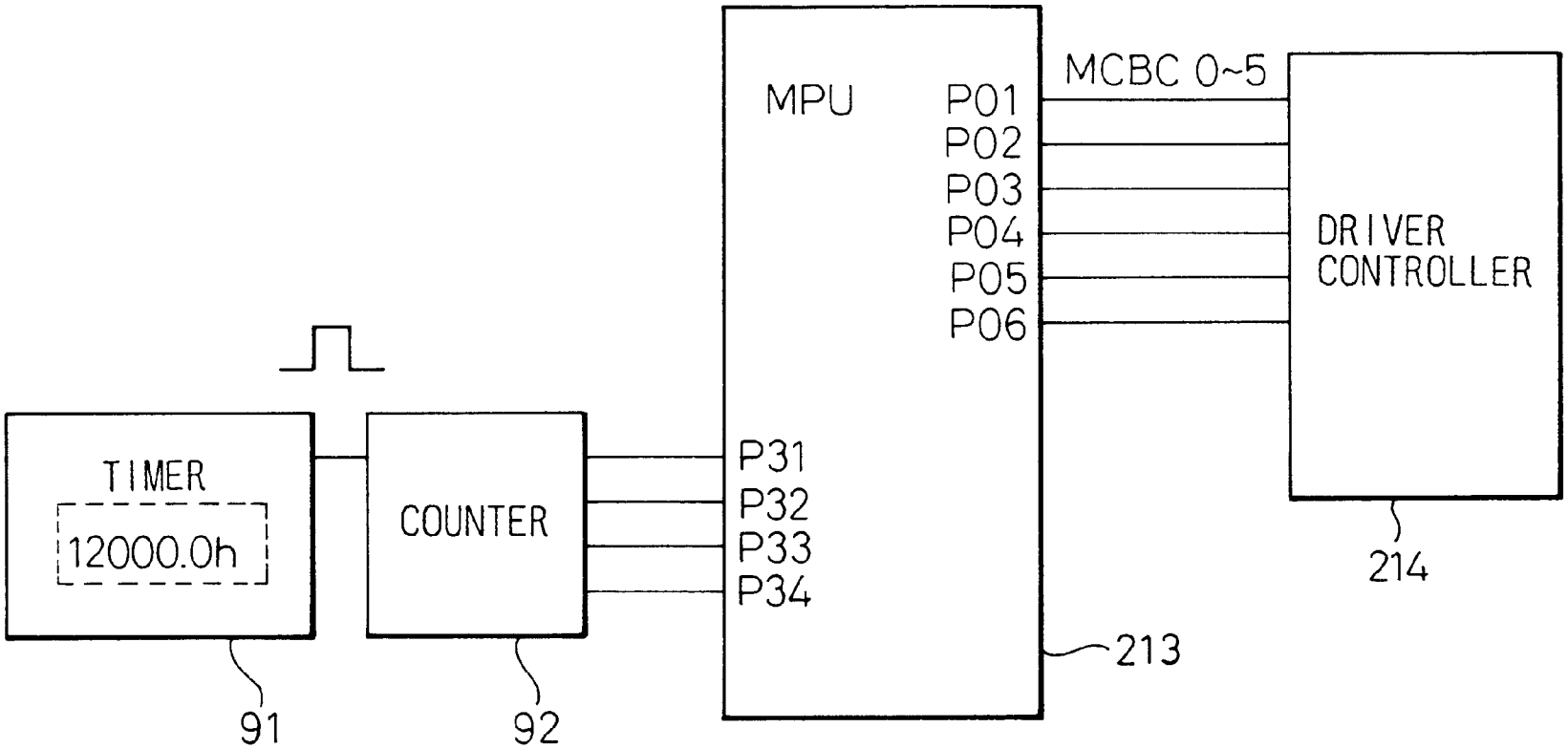
FIG. 17 is a block diagram explaining an alternative embodiment, adaptable to each of the foregoing embodiments, providing compensation for brightness deterioration by increasing the APC set point in accordance with measured operating time of a display panel.

Since a PDP effectively comprises discharge tubes (i.e., an array of gaseous discharge cells), the brightness of the PDP deteriorates after it is used for a long time. The brightness deterioration can be compensated by counting operating time in a counter 92 of FIG. 17, and by increasing the APC set point according to the operating time.

We claim:

1. A display apparatus comprising:

a display panel including a plurality of display cells;

a storage unit for storing a brightness value;

an operation unit calculating a difference between a brightness value input to the operation unit and said brightness value stored in said storage unit, and updating said brightness value stored in said storage unit when the calculated difference is larger than a reference value; and a display driver for individually driving the display cells of said display panel in response to the brightness value stored in said storage unit.

2. A display apparatus as claimed in claim 1, further comprising:

a brightness control pulse generator periodically generating a brightness control pulse, a duration of which is proportional to an analog brightness value; and a counter counting horizontal synchronizing signals applied to said display panel while the brightness control pulse exists, to thereby output a count value as the brightness value input to the operation unit.

3. A display apparatus as claimed in claim 2, further comprising:

a corrected brightness control pulse generator generating a corrected brightness control pulse, a duration of which is proportional to the brightness value stored in said storage unit; and a read only memory storing a first control signal pattern, that causes said display driver to output sustain pulses to said display panel, and a second control signal pattern that does not cause said display driver to output the sustain pulses to said display panel, and selectively outputting the first and the second control signal patterns to said display driver in response to the corrected brightness control pulse.

4. A display apparatus as claimed in claim 3, wherein said corrected brightness control pulse generator includes:

an edge detecting circuit for detecting a rising edge of the brightness control pulse generated by the brightness control pulse generator;

a second counter counting the horizontal synchronizing signals from the rising edge detected by the edge detecting circuit; and a comparator comparing a count value, as counted by the second counter, with the brightness value, as stored in said storage unit, and outputting a comparison result as the corrected brightness control pulse.

5. A display apparatus as claimed in claim 1, further comprising:

a power consumption detector detecting power consumption in said display panel and outputting a power consumption value;

a comparator comparing the power consumption value with a reference value and outputting a comparison result;

a controller gradually changing an automatic power control output thereof in response to the comparison result; and a calculator modifying the brightness value input to the operation unit with the automatic power control output.

6. A display controller for controlling a display driver that drives a display panel, comprising:

a storage unit storing a brightness value, the stored brightness value being used by the display driver; and an operation unit calculating a difference between a brightness value input to the operation unit and said brightness value stored in said storage unit, and updating said brightness value stored in said storage unit when the calculated difference is larger than a reference value, the updated brightness value being the stored brightness value used by the display driver.

7. A display controller as claimed in claim 6, further comprising:

a brightness control pulse generator periodically generating a brightness control pulse, a duration of which is proportional to an analog brightness value; and a counter counting horizontal synchronizing signals applied to said display panel while the brightness control pulse exists, to thereby output a count value as the brightness value input to the operation unit.

8. A display controller as claimed in claim 7, further comprising:

a corrected brightness control pulse generator generating a corrected brightness control pulse, a duration of which is proportional to the brightness value stored in said storage unit; and a read only memory storing a first control signal pattern, that causes the display driver to output effective sustain pulses to the display panel, and a second control signal pattern, that does not cause the display driver to output the sustain pulses to the display panel, and selectively outputting the first and the second control signal patterns to the display driver in response to the corrected brightness control pulse.

9. A display controller as claimed in claim 8, wherein said corrected brightness control pulse generator includes:

an edge detecting circuit for detecting a rising edge of the brightness control pulse generated by the brightness control pulse generator;

a second counter counting the horizontal synchronizing signals from the rising edge detected by the edge detecting circuit; and a comparator comparing a count value, as counted by the second counter, with the brightness value, as stored in said storage unit, and outputting a comparison result as the corrected brightness control pulse.

10. A display controller as claimed in claim 6, further comprising:

a power consumption detector detecting power consumption in a display panel and outputting a power consumption value, a comparator comparing the power consumption value with a reference value and outputting a comparison result;

a controller gradually changing an automatic power control output thereof in response to the comparison result; and a calculator modifying the brightness value input to the operation unit with the automatic power control output.

11. A method of controlling a display driver that drives a display panel comprising the steps of:

storing a brightness value in a memory, the stored brightness value being used by the display driver;

calculating a difference between an input brightness value and the brightness value stored in the memory; and updating the brightness value stored in the memory when the difference calculated in the calculating step is larger than a reference value, the updated brightness value being the stored brightness value used by the display driver.

12. A method as claimed in claim 11, further comprising the step of:

periodically generating a brightness control pulse, a duration of which is proportional to an analog brightness value; and counting horizontal synchronizing signals applied to said display panel while the brightness control pulse exists, to thereby obtain a count value as the input brightness value.

13. A method as claimed in claim 12, further comprising the steps of:

generating a corrected brightness control pulse, a duration of which is proportional to the brightness value stored in the memory;

reading from a read-only memory a first control signal pattern, that causes the display driver to output effective sustain pulses to the display panel, and a second control signal pattern, that does not cause the display driver to output the sustain pulses to the display panel, and selectively outputting the first and the second control signal patterns to the display driver in response to the corrected brightness control pulse.

14. A method as claimed in claim 13, wherein said corrected brightness control pulse generating step includes the substeps of:

detecting a rising edge of the brightness control pulse generated in the brightness control pulse generating step;

counting the horizontal synchronizing signals from the rising edge detected in the edge detecting substep; and comparing a count value counted in the counting substep with the brightness value stored in the memory and outputting a comparison result as the corrected brightness control pulse.

15. A method as claimed in claim 11, further comprising the steps of:

detecting power consumption in the display panel and outputting a power consumption value;

comparing the power consumption value with a reference value, the stored brightness value being used by the display drive;

gradually changing an automatic power control output thereof in response to the comparison result; and modifying the input brightness value with the changing automatic power control output.

16. A display apparatus comprising:

a display panel including a plurality of display cells;

a detector detecting power consumption in said display panel and outputting a power consumption value;

a controller gradually decreasing a brightness value output thereof, when the power consumption value is larger than a set point, and gradually adjusting the brightness value to a brightness set value, when the power consumption value is smaller than the set point; and a display driver individually driving the display cells of said display panel in response to the brightness value output so that brightness of the display cells varies according to the brightness value.

17. A display apparatus, as claimed in claim 16, wherein:

said controller periodically compares the power consumption value with the set point, in a first interval, and decrements the brightness value when the power consumption value is larger than the set point, to thereby gradually decrease the brightness value; and said controller periodically compares the brightness value with the brightness set value, in a second interval, when the power consumption value is smaller than the set point, increments the brightness value when the brightness value is smaller than the brightness set value, and decrements the brightness value when the brightness value is larger than the brightness set value and gradually adjusts the brightness value to the brightness set value.

18. A display apparatus, as claimed in claim 17, wherein the first interval is larger than the second interval.

19. A display apparatus, as claimed in claim 17, wherein the first interval and the second interval are externally variable.

20. A display apparatus, as claimed in claim 16, wherein the set point is varied by being multiplied by the brightness set value.

21. A display apparatus as claimed in claim 16 wherein the power consumption is determined as a product of power voltage and power current, said detector detecting the power voltage; and said controller correcting one of the power consumption value and the set point according to the detected power voltage.

22. A display apparatus, as claimed in claim 16, wherein the brightness value is controlled as a function of the brightness value and the power consumption when the power consumption is smaller than the set point.

23. A display apparatus, as claimed in claim 16, further comprising:

a circuit monitoring the operating time of said display panel; and said controller changes the set point according to the operating time.

24. A display controller for controlling a display driver that drives a display panel, comprising:

a detector detecting power consumption in the display panel and outputting a power consumption value; and a controller controlling the brightness value, by gradually decreasing the brightness value when the power consumption value is larger than a set point and gradually adjusting the brightness value to a brightness set value when the power consumption value is smaller than the set point, and outputting the controlled brightness value to the display driver for use thereby.

25. A display controller, as claimed in claim 24, wherein:

the controller periodically compares the power consumption value with the set point in a first interval and decrements the brightness value when the power consumption value is larger than the set point, to thereby gradually decrease the brightness value; and said controller periodically compares the brightness value with the brightness set value in a second interval when the power consumption value is smaller than the set point, increments the brightness value when the brightness value is smaller than the brightness set value and decrements the brightness value when the brightness value is larger than the brightness set value, gradually adjusting the brightness value to the brightness set value.

26. A display controller, as claimed in claim 25, wherein the first interval is larger than the second interval.

27. A display controller, as claimed in claim 25, wherein the first interval and the second interval are externally variable.

28. A display controller, as claimed in claim 24, wherein the set point is varied by being multiplied by the brightness set value.

29. A display controller as claimed in claim 24, wherein the power consumption is determined as a product of power voltage and power current, said detector detecting the power voltage; and said controller correcting one of the power consumption value and the set point according to the detected power voltage.

30. A display controller, as claimed in claim 24, wherein the brightness value is controlled as a function of the brightness value and the power consumption when the power consumption is smaller than the set point.

31. A display controller, as claimed in claim 24, further comprising:

a circuit monitoring the operating time of the display panel; and said controller changes the set point according to the operating time.

32. A method of controlling a display driver that drives a display panel, comprising the steps of:

detecting power consumption in said display panel and outputting a power consumption value;

controlling a brightness value in accordance with:

gradually decreasing a brightness value when the power consumption value is larger than a set point, and gradually adjusting the brightness value to a brightness set value when the power consumption value is smaller than the set point; and outputting the controlled brightness value to the display driver.

33. A method, as claimed in claim 32, wherein:

said gradually decreasing step includes the substeps of:

a) periodically comparing the power consumption value with the set point, and b) decrementing the brightness value when it is decided in substep a) that the power consumption value is larger than the set point; and said gradually adjusting step includes the substeps of:

c) periodically comparing the brightness value with the brightness set value when the power consumption value is smaller than the set point, d) incrementing the brightness value when it is decided in substep c) that the brightness value is smaller than the brightness set value, and e) decrementing the brightness value when it is decided in substep c) that the brightness value is larger than the brightness set value.

34. A method, as claimed in claim 33, wherein an interval of comparison in substep a) is larger than an interval of comparison in substep c).

35. A method, as claimed in claim 33, wherein an interval of comparison in substep a) and an interval of comparison of in substep c) are externally variable.

36. A method, as claimed in claim 32, wherein the set point is varied by being multiplied by the brightness set value.

37. A method, as claimed in claim 32, further comprising the steps of:

detecting a power voltage; and correcting one of the power consumption value and the set point according to the detected power voltage.

38. A method, as claimed in claim 32, wherein the brightness value is controlled as a function of the brightness value and the power consumption when the power consumption is smaller than the set point.

39. A method, as claimed in claim 32, further comprising the steps of:

monitoring operating time of said display panel; and changing the set point according to the operating time.

40. A display controller for controlling a display driver that drives a display panel comprising:

a detector, connected to a power supply line to the display panel, detecting power consumption by detecting a current flowing through the power supply line and outputting an analog detection signal; and a microprocessor unit, connected to the display driver, comparing a digital detecting value obtained from the analog detection signal with a reference value, determining a digital brightness value based on the comparison result and outputting the digital brightness value to the display driver, the microprocessor unit gradually decreasing the digital brightness value when the digital detection value is larger than the reference value.

41. A display controller as claimed in claim 40, wherein the power consumption is determined as a product of power voltage and power current, said detector detecting the power voltage; and said microprocessor unit correcting one of the digital detecting value and the reference value according to the detected power voltage.

42. A display controller as claimed in claim 40, wherein the digital brightness value is controlled as a function of the digital brightness value and the digital detecting value when the digital detecting value is smaller than the reference value.

43. A display controller, as claimed in claim 40, further comprising:

a circuit monitoring the operating time of the display panel; and said microprocessor unit changes the reference value according to the operating time.

44. A display apparatus, comprising:

a display panel including a plurality of display cells;

a detector, connected to a power supply line in turn connected to the display panel, detecting power consumption by detecting a current flowing through the power supply line and outputting an analog detection signal;

a display driver;

a microprocessor unit, connected to the display driver, comparing a digital detecting value obtained from the analog detecting signal with a reference value, determining a digital brightness value based on the comparison result and outputting the digital brightness value to the display driver, the microprocessor unit gradually decreasing the digital brightness value when the digital detection value is larger than the reference value; and the display driver individually driving the display cells of said display panel in response to the digital brightness value output of the microprocessor unit so that brightness of the display cells varies according to the digital brightness value.

45. A display apparatus as claimed in claim 44, wherein the power consumption is determined as a product of power voltage and power current, said detector detecting the power voltage; and said microprocessor unit correcting one of the digital detecting value and the reference value according to the detected power voltage.

46. A display apparatus as claimed in claim 44, wherein the digital brightness value is controlled as a function of the digital brightness value and the digital detecting value when the digital detecting value is smaller than the reference value.

47. A display apparatus as claimed in claim 44, further comprising:

a circuit monitoring the operating time of the display panel; and said microprocessor unit changes the reference value according to the operating time.

48. A method of controlling a display driver that drives a display panel, comprising the steps of:

detecting power consumption in said display panel and outputting an analog detection signal;

converting the analog detecting signal to a digital detecting value;

comparing the digital detecting value with a reference value and determining a digital brightness value based on the comparison result, in a microprocessor unit, the microprocessor unit gradually decreasing the digital brightness value when the digital detection value is larger than the reference value; and outputting the digital brightness value from the microprocessor unit to the display driver.

49. A method as claimed in claim 48, wherein the power consumption is determined as a product of power voltage and power current, further comprising the steps of:

detecting the power voltage; and correcting one of the digital detecting value and the reference value according to the detected power voltage.

50. A method as claimed in claim 48, wherein the digital brightness value is controlled as a function of the digital brightness value and the digital detecting value when the digital detecting value is smaller than the reference value.

51. A method as claimed in claim 48, further comprising the steps of:

monitoring the operating time of the display panel; and changing the reference value according to the operating time.

* * * * *